US011400703B2

(12) United States Patent
Toda et al.

(10) Patent No.: US 11,400,703 B2
(45) Date of Patent: Aug. 2, 2022

(54) LIQUID EJECTION APPARATUS AND SYSTEM

(71) Applicant: Brother Kogyo Kabushiki Kaisha, Nagoya (JP)

(72) Inventors: Yuta Toda, Nagoya (JP); Zenichiro Sasaki, Nagoya (JP); Yasuhiro Nakano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/162,184

(22) Filed: Jan. 29, 2021

(65) Prior Publication Data

US 2021/0237429 A1 Aug. 5, 2021

(30) Foreign Application Priority Data

Jan. 31, 2020 (JP) ..... JP2020-014437

(51) Int. Cl.
*B41J 2/045* (2006.01)
*B41J 2/135* (2006.01)
*B41J 2/125* (2006.01)

(52) U.S. Cl.
CPC ..... *B41J 2/0451* (2013.01); *B41J 2/135* (2013.01); *B41J 2/125* (2013.01)

(58) Field of Classification Search
CPC ..... B41J 2/0451; B41J 2/04586; B41J 2/135; B41J 2/125
See application file for complete search history.

(56) References Cited

U.S. PATENT DOCUMENTS

| | | | | |
|---|---|---|---|---|
| 8,491,084 | B2 | 7/2013 | Sato et al. | |
| 9,056,512 | B1 * | 6/2015 | Kanzaki | B41J 2/17596 |
| 2007/0139461 | A1 | 6/2007 | Izuo | |
| 2011/0063366 | A1 | 3/2011 | Sato et al. | |
| 2014/0300657 | A1 | 10/2014 | Ike | |

FOREIGN PATENT DOCUMENTS

| | | | |
|---|---|---|---|
| JP | 2003-300313 | A | 10/2003 |
| JP | 2007-140959 | A | 6/2007 |
| JP | 2007-152889 | A | 6/2007 |
| JP | 2011-062847 | A | 3/2011 |
| JP | 2014-200982 | A | 10/2014 |
| JP | 2015-178178 | A | 10/2015 |

* cited by examiner

*Primary Examiner* — Thinh H Nguyen
(74) *Attorney, Agent, or Firm* — Banner & Witcoff, Ltd.

(57) ABSTRACT

A liquid ejection apparatus includes a liquid ejection head having an array of nozzles each configured to eject liquid, a storage, and a controller. The storage stores first data including distribution patterns and causes of an ejection failure and second data including causes of an ejection failure and maintenance manners. In a case where the nozzles include a failure nozzle, the controller determines a cause of a currently-occurring ejection failure based on the first data, perform maintenance in a first maintenance manner associated with the cause based on the second data. In a case where the currently-occurring ejection failure due to the cause has been recovered a predetermined number of times by maintenance in the first maintenance manner, the controller is configured to change the first maintenance manner associated with the cause to a second maintenance manner in the second data.

12 Claims, 13 Drawing Sheets

FIG. 8A

| DISTRIBUTION PATTERN | CAUSE OF EJECTION FAILURE |
|---|---|
| PATTERN 1 | CAUSE 1 |
| PATTERN 2 | CAUSE 2 |
| PATTERN 3 | CAUSE 3 |
| ⋮ | ⋮ |

FIG. 8B

| CAUSE OF EJECTION FAILURE | MAINTENANCE MANNER | USE PERIOD |
|---|---|---|
| CAUSE 1 | MANNER 1 | PERIOD 1 |
| CAUSE 2 | MANNER 2 | |
| CAUSE 3 | MANNER 3 | |
| ⋮ | ⋮ | |

FIG. 10

| USE REGION | USE PERIOD | DISTRIBUTION PATTERN | CAUSE OF EJECTION FAILURE | MAINTENANCE MANNER |
|---|---|---|---|---|
| REGION 1 | PERIOD 1 | PATTERN 1 | CAUSE 1 | MANNER 1 |
| | | PATTERN 2 | CAUSE 2 | MANNER 2 |
| | | PATTERN 3 | CAUSE 3 | MANNER 3 |
| | | ⋮ | ⋮ | ⋮ |
| | PERIOD 2 | PATTERN 1 | CAUSE 1 | MANNER 1 |
| | | PATTERN 2 | CAUSE 2 | MANNER 3 |
| | | PATTERN 3 | CAUSE 3 | MANNER 4 |
| | | ⋮ | ⋮ | ⋮ |
| | PERIOD 3 | PATTERN 1 | CAUSE 1 | ⋮ |
| | | PATTERN 2 | CAUSE 2 | ⋮ |
| | | PATTERN 3 | CAUSE 3 | ⋮ |
| | | ⋮ | ⋮ | ⋮ |
| | ⋮ | ⋮ | ⋮ | ⋮ |
| REGION 2 | PERIOD 1 | PATTERN 1 | CAUSE 1 | ⋮ |
| | | PATTERN 2 | CAUSE 2 | ⋮ |
| | | PATTERN 3 | CAUSE 3 | ⋮ |
| | | ⋮ | ⋮ | ⋮ |
| | ⋮ | ⋮ | ⋮ | ⋮ |

LIQUID EJECTION APPARATUS AND SYSTEM

CROSS-REFERENCE TO RELATED APPLICATION

This application claims priority from Japanese Patent Application No. 2020-014437 filed on Jan. 31, 2020, the content of which is incorporated herein by reference in its entirety.

TECHNICAL FIELD

Aspects of the disclosure relate to a liquid ejection apparatus that ejects liquid from nozzles and a system including the liquid ejection apparatus.

BACKGROUND

Examples of a liquid ejection apparatus that ejects liquid from nozzles include an inkjet recording apparatus that ejects ink from nozzles. In a case where such an inkjet recording apparatus detects dot missing, the inkjet recording apparatus performs cleaning and then determines whether the dot missing has been resolved. In a case where the dot missing has not been resolved, the inkjet recording apparatus performs cleaning again under another cleaning condition.

SUMMARY

Aspects of the disclosure provide a liquid ejection apparatus and a system including the liquid ejection apparatus that may perform maintenance suitable for a use environment of the liquid ejection apparatus when a liquid ejection failure occurs in one or more nozzles.

According to one or more aspects of the disclosure, a liquid ejection apparatus includes a liquid ejection head having an array of nozzles each configured to eject liquid, a storage, and a controller. The storage stores first data and second data. The first data includes combinations each including one of distribution patterns and one of causes of an ejection failure, each distribution pattern indicating locations of one or more failure nozzles each from which liquid is not normally ejected. The second data includes combinations each including one of causes of an ejection failure and one of maintenance manners, the maintenance manners including a first maintenance manner and a second maintenance manner different from the first maintenance manner. The controller is configured to execute ejection determination to determine whether, with respect to each nozzle a nozzle normally has ejected liquid, and determine, based on a result of the ejection determination, whether the nozzles include a failure nozzle. In a case where the controller determines that the nozzles include a failure nozzle, the controller is configured to determine, based on the first data stored in the storage and a distribution pattern obtained from a result of the ejection determination, a cause of a currently-occurring ejection failure. Subsequent to the execution of the maintenance in the first maintenance manner, the controller is configured to execute again the ejection determination and determine, based on a result of the ejection determination, whether the currently-occurring ejection failure due to the certain cause has been recovered by the maintenance in the first maintenance manner. In a case where the currently-occurring ejection failure due to the certain cause has been recovered a predetermined number of times by the maintenance in the first maintenance manner, the controller is configured to change the first maintenance manner associated with the certain cause to the second maintenance manner in the second data.

According to the one or more aspects of the disclosure, appropriateness of associations between causes of an ejection failure and maintenance manners may be improved. Thus, when an ejection failure occurs, such a control may enable the liquid ejection apparatus to perform maintenance in a suitable maintenance manner.

BRIEF DESCRIPTION OF THE DRAWINGS

FIG. 8A is a cause determination table according to one or more embodiments of the disclosure.

FIG. 8B is a maintenance determination table according to one or more embodiments of the disclosure.

FIG. 10 is a table stored in the server according to one or more embodiments of the disclosure.

DETAILED DESCRIPTION

Hereinafter, an illustrative embodiment will be described with reference to the accompanying drawings.

General Configuration of Printer

Figure 1:
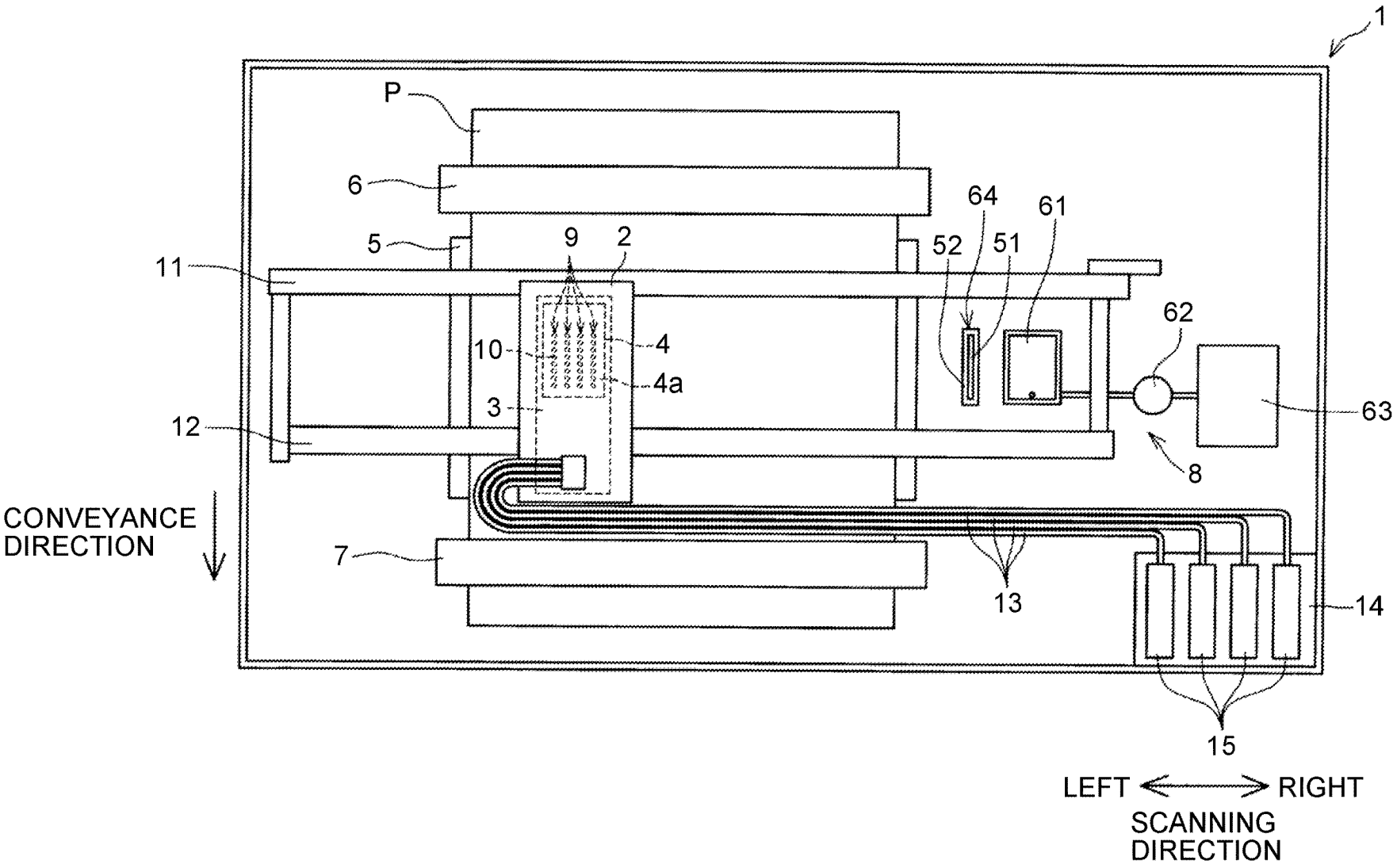
FIG. 1 is a schematic view illustrating a mechanical configuration of a printer according to one or more embodiments of the disclosure.

As illustrated in FIG. 1, a printer 1 includes a carriage 2, a sub tank 3, an inkjet head 4, a platen 5, conveyance rollers 6 and 7, and a maintenance unit 8. The printer 1 is an example of a liquid ejection apparatus. The inkjet head 4 is an example of a liquid ejection head.

The carriage 2 is supported by guide rails 11 and 12 each extending in a scanning direction. The carriage 2 is connected to a carriage motor 86 (refer to FIG. 4) via a belt. In response to the carriage motor 86 being driven, the carriage 2 moves in the scanning direction along the guide rails 11 and 12. The scanning direction corresponds to a right-left direction as illustrated in FIG. 1.

The sub tank 3 is mounted on the carriage 2. The printer 1 further includes a cartridge holder 14. The cartridge holder 14 accommodates a plurality of, for example, four, ink cartridges 15 that are detachably attached thereto. The ink cartridges 15 are arranged next to each other in the scanning direction. The rightmost ink cartridge 15 in the scanning direction stores black ink. The ink cartridge 15 to the left of the black ink cartridge 15 stores yellow ink. The ink cartridge 15 to the left of the yellow ink cartridge 15 stores cyan ink. The ink cartridge 15 to the left of the cyan ink cartridge 15 stores magenta ink. Ink is an example of liquid. The sub tank 3 is connected, via respective corresponding tubes 13, to the ink cartridges 15 attached to the cartridge holder 14. Such a configuration may thus enable supply of ink of four colors to the sub tank 3 from the respective ink cartridges 15.

The inkjet head 4 is mounted on the carriage 2 and is connected to a lower end portion of the sub tank 3. The inkjet head 4 is supplied with ink of four colors from the sub tank 3. The inkjet head 4 has an array of nozzles 10 defined in its nozzle surface 4*a*. The nozzle surface 4*a* may be a lower surface of the inkjet head 4. The inkjet head 4 ejects ink through one or more of the nozzles 10. More specifically, for example, the nozzles 10 are arranged in rows extending in a conveyance direction orthogonal to the scanning direction to form nozzle rows 9. The inkjet head 4 includes a plurality of, for example, four, nozzle rows 9 next to each other in the scanning direction. In the inkjet head 4, black ink is ejected from the nozzles 10 constituting the rightmost nozzle row 9 in the scanning direction. Yellow ink is ejected from the nozzles 10 constituting the nozzle row 9 to the left of the black nozzle row 9. Cyan ink is ejected from the nozzles 10 constituting the nozzle row 9 to the left of the yellow nozzle row 9. Magenta ink is ejected from the nozzles 10 constituting the nozzle row 9 to the left of the cyan nozzle row 9.

The platen 5 is disposed below the inkjet head 4 and faces the nozzles 10. The platen 5 extends in the scanning direction to have a dimension covering the entire width of a recording sheet P to be conveyed. The platen 5 is configured to support from below a recording sheet P being conveyed. The conveyance roller 6 is disposed upstream from the inkjet head 4 and the platen 5 in the conveyance direction. The conveyance roller 7 is disposed downstream from the inkjet head 4 and the platen 5 in the conveyance direction. The conveyance rollers 6 and 7 are connected to a conveyance motor 87 (refer to FIG. 4) via gears. In response to the conveyance motor 87 being driven, the conveyance rollers 6 and 7 rotate to convey a recording sheet P in the conveying direction.

The printer 1 records an image on a recording sheet P by performing scanning and sheet conveyance alternately. In scanning, the inkjet head 4 ejects ink through one or more nozzles 10 while the carriage 2 moves in the scanning direction. In sheet conveyance, the printer 1 conveys a recording sheet P using the conveyance rollers 6 and 7 in the conveyance direction.

The maintenance unit 8 includes a cap 61, a suction pump 62, a waste liquid tank 63, and a wiper 64. The cap 61 is disposed to the right of the platen 5 in the scanning direction. When the carriage 2 is located at a maintenance position, the nozzles 10 face the cap 61. The maintenance position is further to the right than the platen 5 in the scanning direction.

Figure 4:
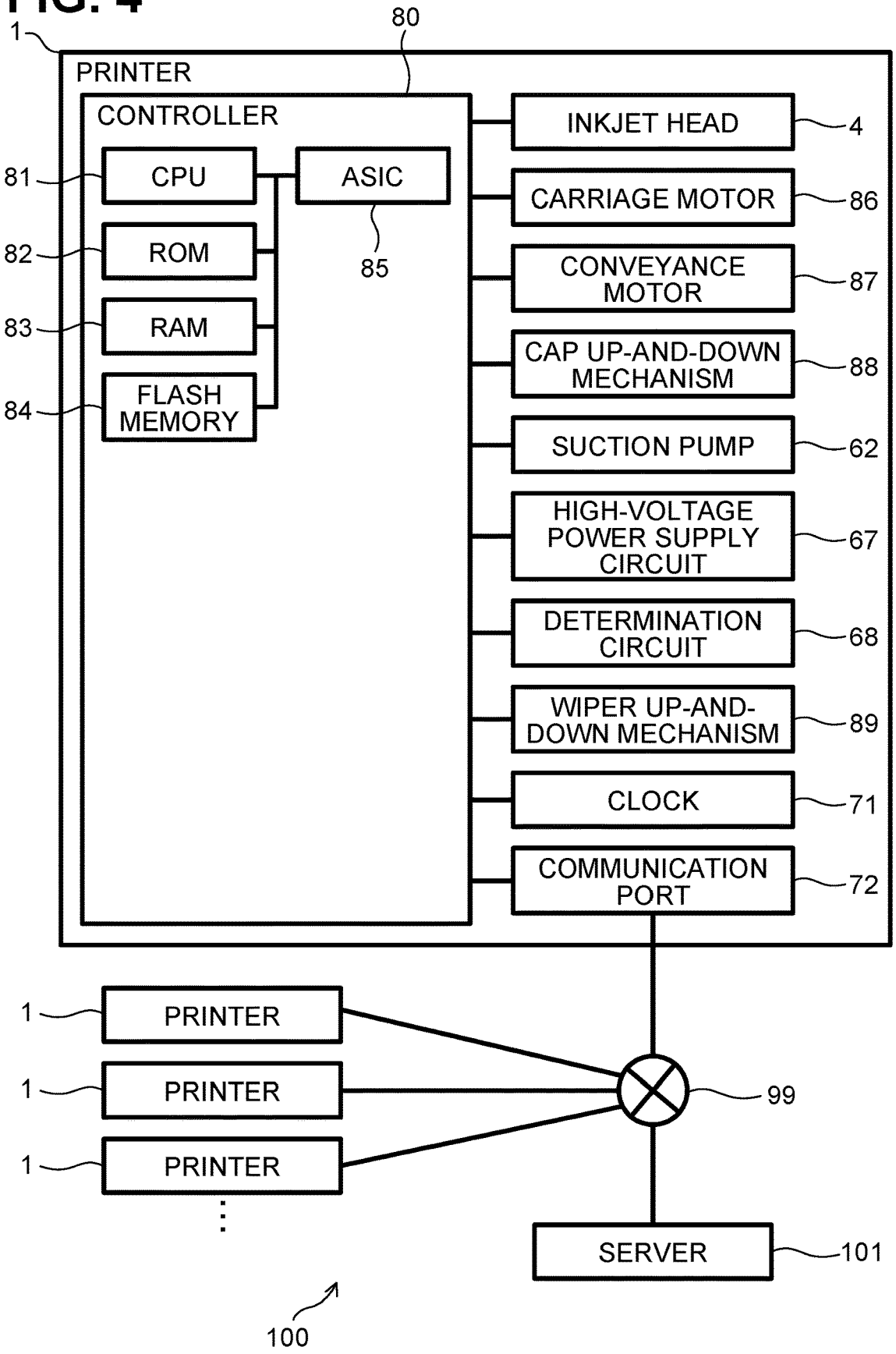
FIG. 4 is a block diagram illustrating an electrical configuration of the printer of FIG. 1 and a configuration of a system including the printer of FIG. 1 and other printers that are the same model as the printer of FIG. 1 according to one or more embodiments of the disclosure.

The cap 61 is movable upward and downward selectively by control of a cap up-and-down mechanism 88 (refer to FIG. 4). The carriage 2 is moved to stop at the maintenance position so that the nozzles 10 and the cap 61 face each other. In such a state, in response to the cap 61 being moved upward by the cap up-and-down mechanism 88, an upper end portion of the cap 61 intimately contacts the nozzle surface 4*a* of the inkjet head 4 to cover the nozzles 10. The cap 61 is not limited to have such a configuration to intimately contact the nozzle surface 4*a* to cover the nozzles 10. In other embodiments, for example, the cap 61 may intimately contact a frame surrounding the nozzle surface 4*a* of the inkjet head 4 to cover the nozzles 10.

The suction pump 62 may be a tube pump. The suction pump 62 is connected to the cap 61 and the waste liquid tank 63. The maintenance unit 8 performs a suction purge. More specifically, for example, in response to the suction pump 62 being driven in a state where the nozzles 10 are covered by the cap 61, the inkjet head 4 is caused to discharge ink from the nozzles 10 by suction by the suction pump 62. Ink discharged from the inkjet head 4 by the suction purge is collected in the waste liquid tank 63.

For the sake of convenience, in the illustrative embodiment, the cap 61 covers all the nozzles 10 of the inkjet head 4 and ink is discharged from the inkjet head 4 through all the nozzles 10 in a suction purge. Nevertheless, in other embodiments, for example, the cap 61 may include capping portions, each of which may cover corresponding nozzles of the nozzles 10 of the inkjet head 4. One of the capping portions may cover the nozzles 10 constituting the rightmost nozzle row 9 through which black ink is discharged, and the other of the capping portion may cover the nozzles 10 constituting the remaining nozzle rows 9 through which respective color inks (e.g., yellow, cyan, and magenta inks) are discharged. Such a configuration may enable black ink and color inks to be selectively discharged from the inkjet head 4 in a suction purge. Alternatively, for example, the maintenance unit 8 may include a plurality of caps 61 for respective nozzle rows 9. Such a configuration may enable ink to be discharged from the nozzles 10 of the inkjet head 4 on a nozzle row 9 basis.

In the illustrative embodiment, the maintenance unit 8 further performs flushing. More specifically, for example, in a state where the carriage 2 is located at the maintenance position, the inkjet head 4 is driven. In response to this, the inkjet head 4 is caused to discharge ink toward the cap 61 from the nozzles 10. Ink accumulated in the cap 61 by flushing is further discharged from the cap 61 by driving of the suction pump 62 after flushing.

Figure 2:
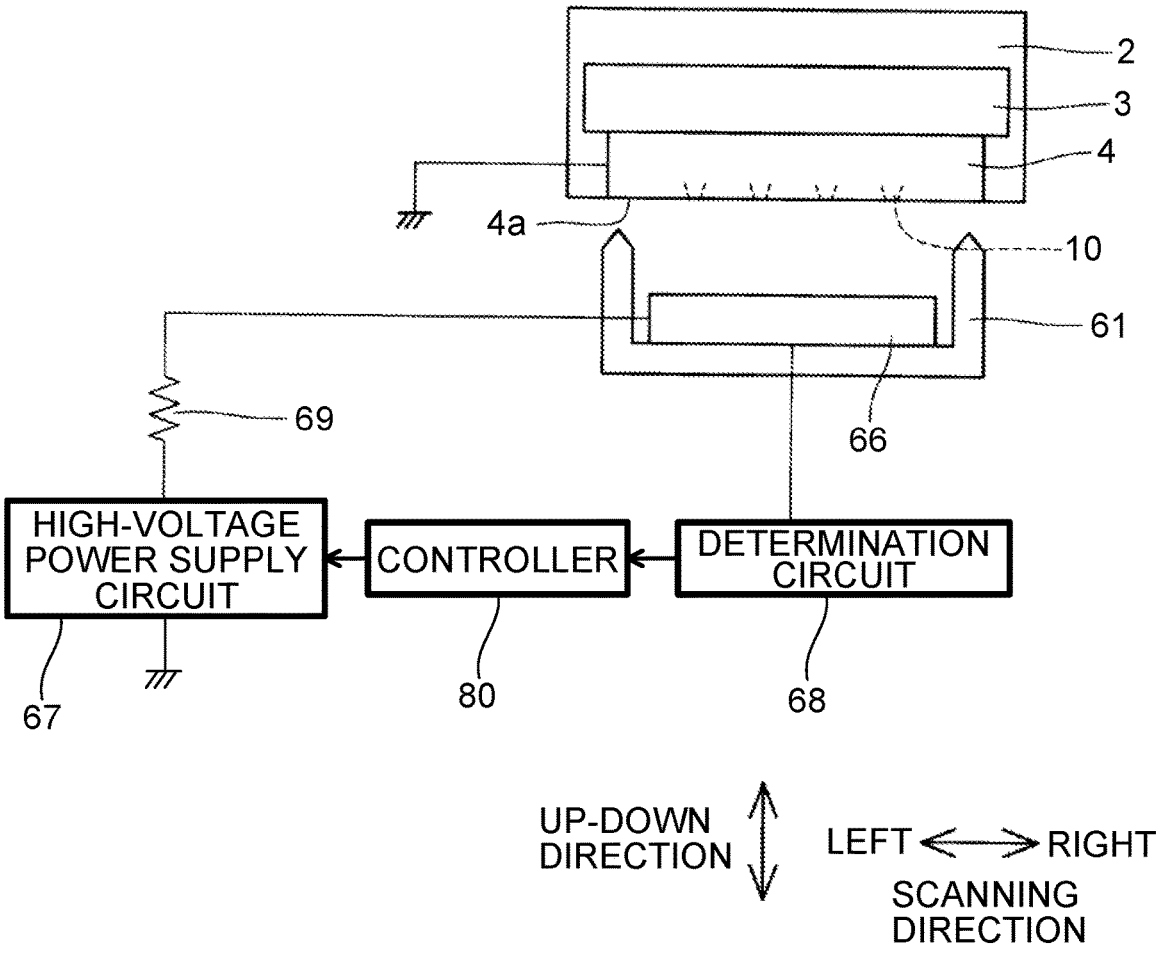
FIG. 2 illustrates a detection electrode disposed in a cap, a connection relationship between the detection electrode and a high-voltage power supply circuit, and a connection relationship between the detection electrode and a determination circuit according to one or more embodiments of the disclosure.

As illustrated in FIG. 2, a detection electrode 66 is disposed in the cap 61. The detection electrode 66 has a rectangular flat shape. The detection electrode 66 is connected to a high-voltage power supply circuit 67 via a resistor 69. The high-voltage power supply circuit 67 applies a certain positive potential (e.g., approximately 300V) to the detection electrode 66. The inkjet head 4 is maintained at a ground potential. Thus, a certain potential difference is caused between the inkjet head 4 and the detection electrode 66. A determination circuit 68 is connected to the detection electrode 66. The determination circuit 68 compares voltage indicated by a voltage signal output from the detection electrode 66 with a threshold Vt, and outputs a determination signal responsive to the comparison result.

Figure 3A:
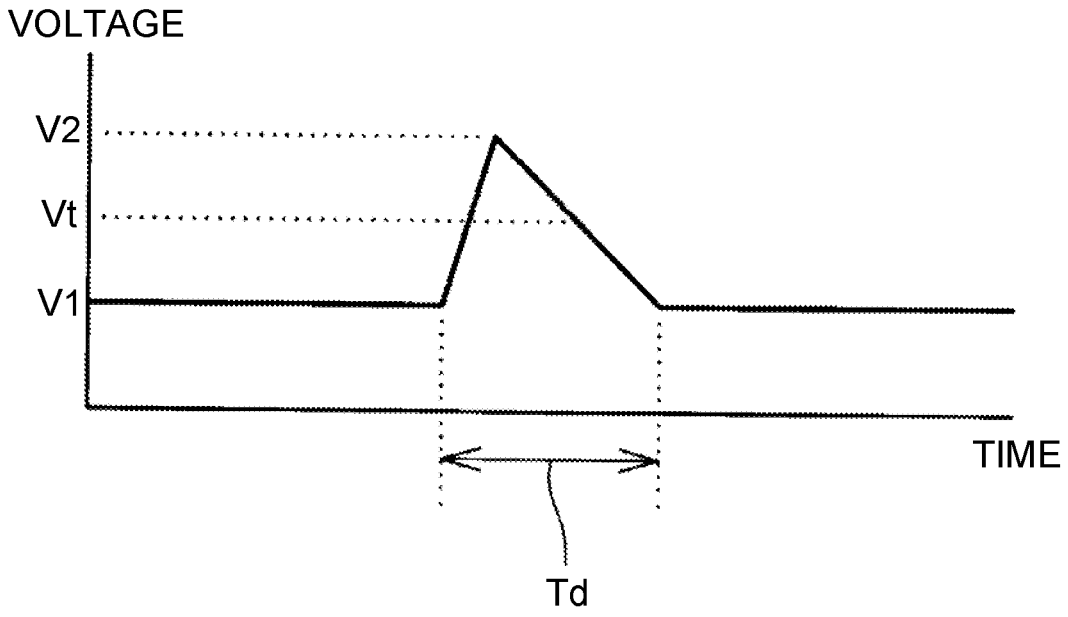
FIG. 3A is a graph showing changes in voltage at the detection electrode in a case where ink ejection through a target nozzle has succeeded according to one or more embodiments of the disclosure.

More specifically, due to the certain potential difference caused between the inkjet head 4 and the detection electrode 66, ink ejected from the nozzles 10 is electrically charged. In a state where the carriage 2 is positioned at the maintenance position, the inkjet head 4 is driven. In response to this, in a case where ink is normally ejected from a target nozzle 10 toward the detection electrode 66, as shown in FIG. 3A, the voltage at the detection electrode 66 rises from a voltage V1 as the charged ink approaches the detection electrode 66. The voltage at the detection electrode 66 reaches a voltage V2 that is higher than the voltage V1 until the charged ink reaches the detection electrode 66. The voltage V1 corresponds to the voltage when the inkjet head 4 is not driven. After the charged ink reaches the detection electrode 66, the voltage at the detection electrode 66 gradually lowers to the voltage V1. That is, the voltage at the detection electrode 66 changes in a driving period Td during which the inkjet head 4 is driven.

Figure 3B:
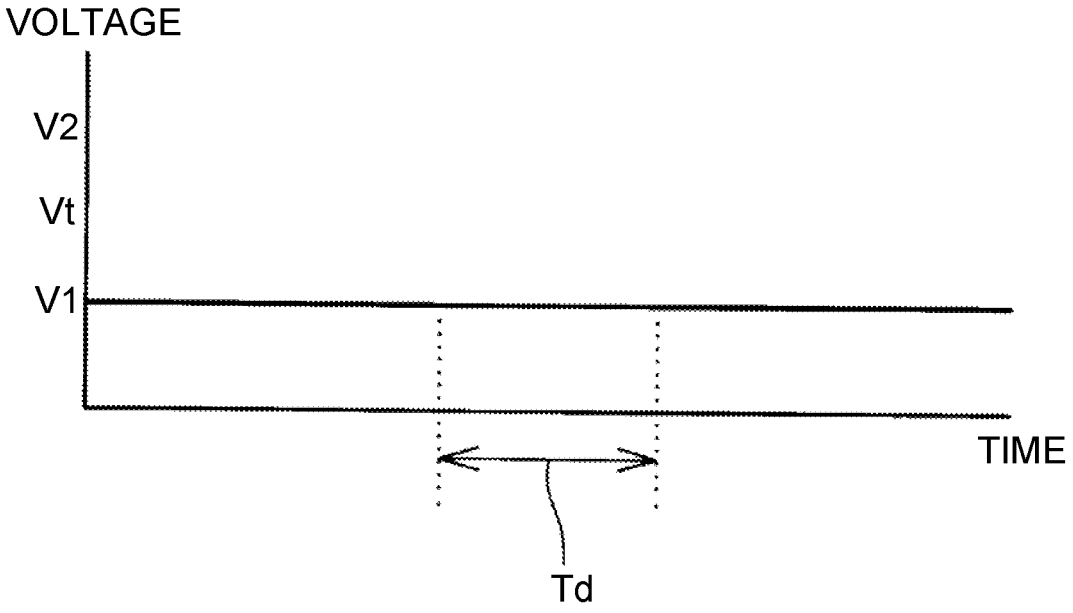
FIG. 3B is a graph showing no change in voltage at the detection electrode in a case where ink ejection through a target nozzle has failed according to one or more embodiments of the disclosure.

In a case where ink is not ejected from the target nozzle 10 although the inkjet head 4 is driven, as shown in FIG. 3B, the voltage at the detection electrode 66 is maintained almost constant at the voltage V1 in the driving period Td of the inkjet head 4. Thus, a threshold Vt ($V1<Vt<V2$) is specified to enable the determination circuit 68 to distinguish those above cases. The determination circuit 68 compares a maximum voltage output from the detection electrode 66 with the threshold Vt in the driving period Td of the inkjet head 4, and outputs a determination signal responsive to the comparison result. In other words, the determination circuit 68 outputs a determination signal responsive to whether a target nozzle 10 has normally ejected ink. In the illustrative embodiment, a combination of the detection electrode 66, the high-voltage power supply circuit 67, the resistor 69, and the determination circuit 68 corresponds to a signal output unit.

In the illustrative embodiment, a positive potential is applied to the detection electrode 66 by the high-voltage power supply circuit 67. Nevertheless, in other embodiments, for example, a negative potential (e.g., approximately −300V) may be applied to the detection electrode 66 by the high-voltage power supply circuit 67. In such a case, in a state where the carriage 2 is positioned at the maintenance position, the inkjet head 4 may be driven. In response to this, in a case where ink is normally ejected from a target nozzle 10 toward the detection electrode 66, the voltage at the detection electrode 66 may lower from the voltage V1 as the charged ink approaches the detection electrode 66. After the charged ink reaches the detection electrode 66, the voltage at the detection electrode 66 may gradually rise to the voltage V1.

The wiper 64 is disposed between the platen 5 and the cap 61 in the scanning direction. The wiper 64 includes a wiper blade 51 and a support 52. The wiper blade 51 may include an elastic material such as rubber. The wiper blade 51 may be a thin plate-like member extending in both the conveyance direction and an up-down direction. The support 52 supports a lower end portion of the wiper blade 51. The wiper 64 is movable upward and downward by control of a wiper up-and-down mechanism 89 (refer to FIG. 4). In a state where the wiper 64 is lowered, an upper end of the wiper blade 51 is positioned below the nozzle surface 4*a*. In a state where the wiper 64 is raised, the upper end of the wiper blade 51 is positioned above the nozzle surface 4*a*.

In a case where the wiper 64 is kept raised, the carriage 2 is moved in the scanning direction until the nozzle surface 4*a* of the inkjet head 4 passes a level at which the nozzle surface 4*a* overlaps the wiper blade 51 in the up-down direction. During the movement of the carriage 2, the nozzle surface 4*a* and the wiper blade 51 move relative to each other in the scanning direction while the wiper blade 51 contacts the nozzle surface 4*a* with the upper end of the wiper blade 51 being elastically deformed. This may be wiping in which the wiper blade 51 wipes ink adhering to the nozzle surface 4*a*.

Electrical Configuration of Printer

Hereinafter, a description will be provided on an electrical configuration of the printer 1. The printer 1 further includes a controller 80. The controller 80 controls the printer 1. As illustrated in FIG. 4, the controller 80 includes a CPU 81, a ROM 82, a RAM 83, a flash memory 84, and an ASIC 85. The controller 80 controls the inkjet head 4, the carriage motor 86, the conveyance motor 87, the cap up-and-down mechanism 88, the high-voltage power supply circuit 67, the suction pump 62, and the wiper up-and-down mechanism 89.

In the controller 80, only the CPU 81 or the ASIC 85 may perform all processing or a combination of the CPU 81 and the ASIC 85 may perform all processing. Alternatively, the controller 80 may include a single CPU 81 that may perform all processing or include a plurality of CPUs 81 that may share all processing. Alternatively, the controller 80 may include a single ASIC 85 that may perform all processing or include a plurality of ASICs 85 that may share all processing.

The controller 80 receives a determination signal from the determination circuit 68. The printer 1 further includes a clock 71. The controller 80 receives, from the clock 71, a signal indicating the current date and time. The printer 1 further includes a communication port 72. The communication port 72 may be, for example, a LAN port. The controller 80 is connected to a network 99 such as the Internet via the communication port 72. The communication port 72 may allow the controller 80 to be connected to the network 99 in a wired or wireless manner.

In the illustrative embodiment, two or more printers 1 are connected to a server 101 via the network 99. The server 101 includes a CPU, a ROM, a RAM, and a flash memory. The server 101 performs processing described below. In the illustrative embodiment, a system 100 is configured by the printers 1 and the server 101 connected to each other via the network 99.

Ejection Detection and Maintenance

All the printers 1 connected to the server 101 via the network 99 are the same model printers that operate in the same manner, and therefore, a description will be provided on one of the printers 1. In the printer 1, the controller 80 executes processing of FIG. 5 to execute ejection determination and perform suitable maintenance. In the ejection determination, the controller 80 determines whether each of the nozzles 10 of the inkjet head 4 has normally ejected ink.

Figure 5:
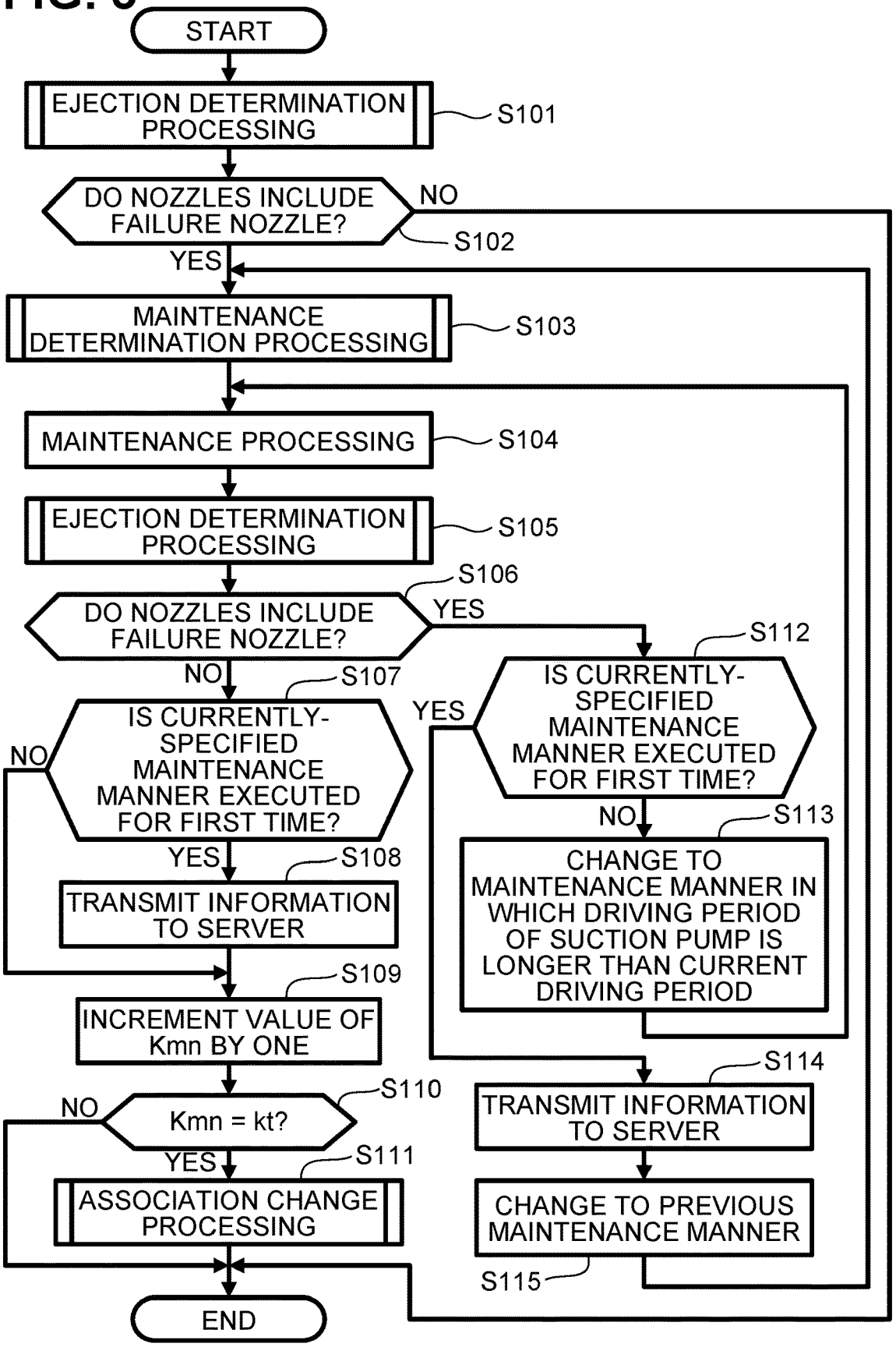
FIG. 5 is a flowchart of processing for detecting a failure nozzle and performing a suitable maintenance in each printer according to one or more embodiments of the disclosure.

In one example, in response to the printer 1 receiving an instruction to record an image, the controller 80 executes the processing of FIG. 5 immediately before starting image recording. In another example, in response to the printer 1 receiving an instruction to perform maintenance, the controller 80 executes the processing of FIG. 5. The maintenance instruction may be input to the printer 1 by a user via an operation interface of the printer 1 or via a general-purpose computer connected to the printer 1. In still another example, the controller 80 executes the processing of FIG. 5 periodically.

Figure 6:
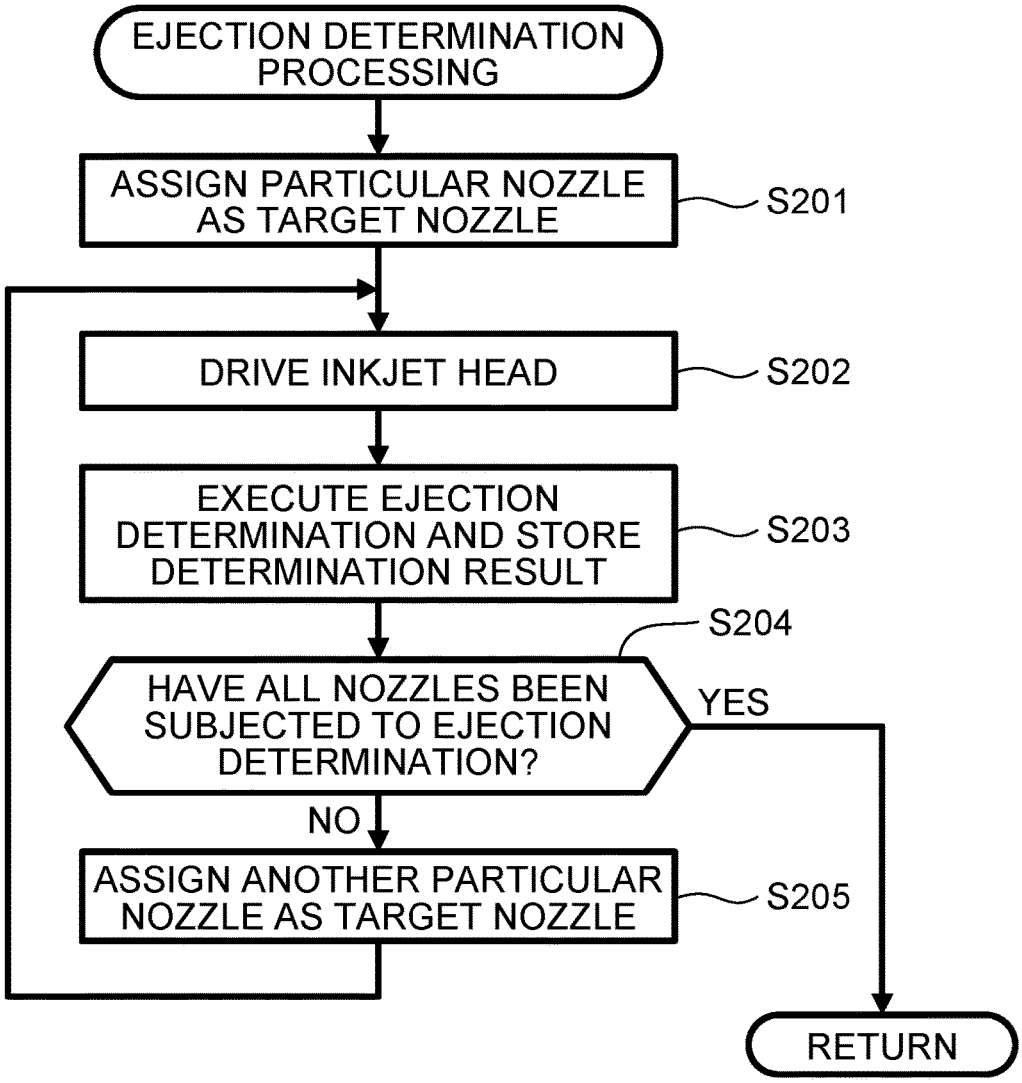
FIG. 6 is a flowchart of ejection determination processing included in the flowchart of FIG. 5 according to one or more embodiments of the disclosure.

As illustrated in FIG. 5, the controller 80 executes ejection determination processing (e.g., step S101). In the ejection determination processing, as illustrated in FIG. 6, the controller 80 assigns a nozzle 10 of the nozzles 10 of the inkjet head 4 as a target nozzle (e.g., step S201). The target nozzle is subjected to a determination as to whether the target nozzle 10 is a failure nozzle from which ink is not normally ejected (ejection failure). Examples of such a failure nozzle may include a nozzle which ejects ink of an amount lower than average, a nozzle which ejects ink of an amount larger than average, and a nozzle which does not eject ink. In this embodiment, a failure nozzle may refer to a nozzle which does not eject ink. Subsequent to step S201, the controller 80 drives the inkjet head 4 (e.g., step S202). More specifically, the controller 80 drives the inkjet head 4 to eject ink from the target nozzle 10. Subsequent to step S202, the controller 80 executes ejection determination to determine whether the target nozzle 10 is a failure nozzle based on a determination signal received from the determination circuit 68, and then stores the determination result of whether the target nozzle 10 is a failure nozzle in the flash memory 84 as nozzle information of the target nozzle 10 (e.g., step S203).

Subsequent to step S203, if the controller 80 determines that all the nozzles 10 have not been subjected to the ejection determination (e.g., NO in step S204), the controller 80 assigns another nozzle 10 as the next target nozzle among one or more nozzles 10 that have not been subjected to the ejection determination (e.g., step S205) and the routine returns to step S202. If the controller 80 determines that all the nozzles 10 have been subjected to the ejection determination (e.g., YES in step S204), the routine proceeds to step S102 of FIG. 5. When the ejection determination for all the nozzles 10 is completed, a failure nozzle distribution pattern (hereinafter, simply referred to as a distribution pattern) is stored in the flash memory 84. The distribution pattern results from the determination results of all the nozzles 10 stored in step S203. In other words, the distribution pattern indicates locations of one or more failure nozzles each from which ink is not normally ejected. The distribution pattern indicates a currently-occurring ejection failure.

Subsequent to the ejection determination processing in step S101, as illustrated in FIG. 5, the controller 80 determines, based on the result of the ejection determination processing in step S101, whether the nozzles 10 of the inkjet head 4 include a failure nozzle, that is, whether an ejection failure has occurred in any of the nozzles 10 (e.g., step S102). If the controller 80 determines that the nozzles 10 of the inkjet head 4 do not include a failure nozzle (e.g., NO in step S102), the processing of FIG. 5 ends. If the controller 80 determines that the nozzles 10 of the inkjet head 4 include a failure nozzle (e.g., YES in step S102), the controller 80 executes maintenance determination processing (e.g., step S103).

Figure 7A:
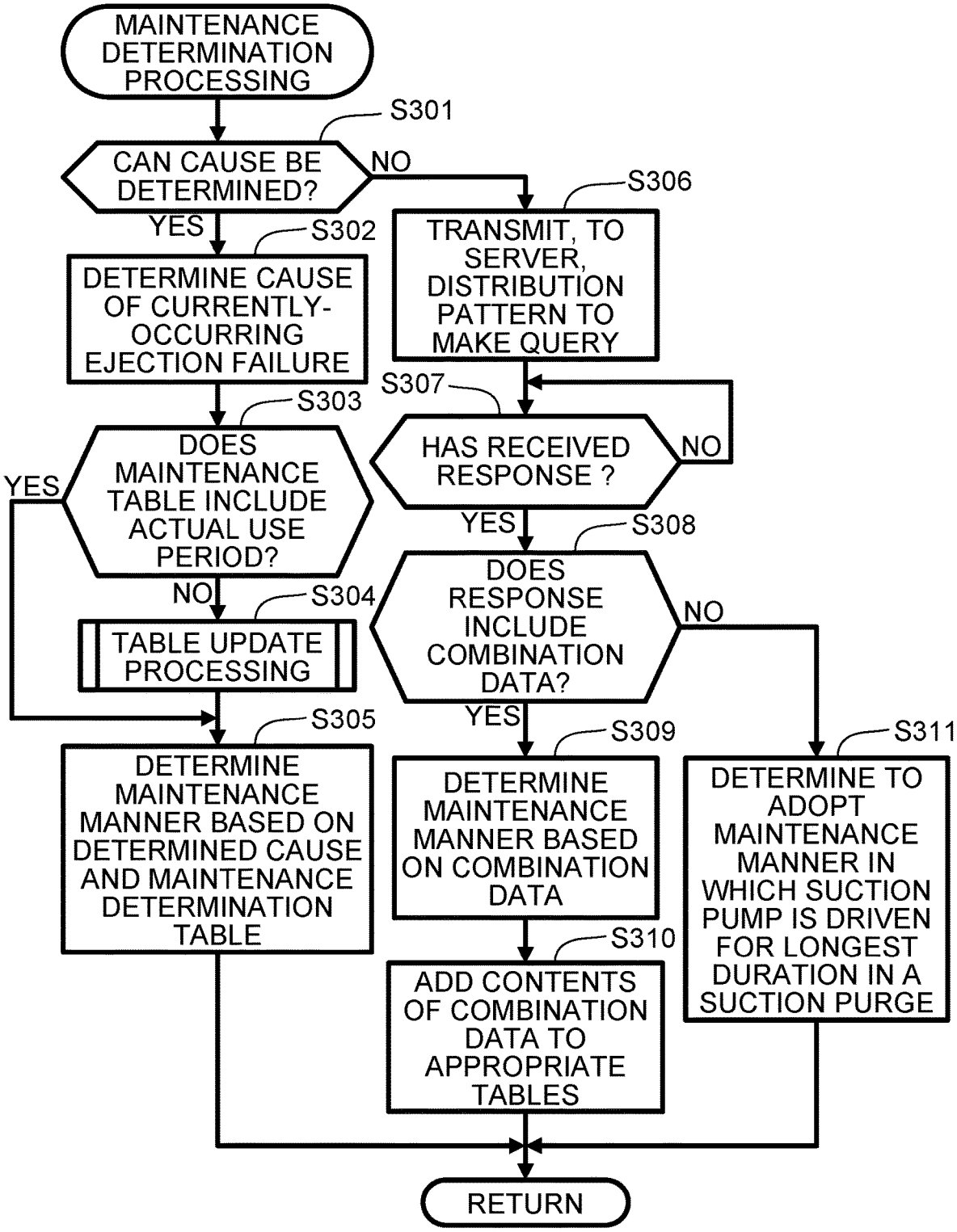
FIG. 7A is a flowchart of maintenance determination processing included in the flowchart of FIG. 5 according to one or more embodiments of the disclosure.

In the maintenance determination processing, as illustrated in FIG. 7A, if the controller 80 determines that the cause that may cause the currently-occurring ejection failure (hereinafter, simply referred to as the cause of the currently-occurring ejection failure) can be determined based on the distribution pattern shown by the result of the ejection determination processing executed in step S101 (e.g., YES in step S301), the controller 80 determines the cause of the currently-occurring ejection failure based on the result of the ejection determination processing executed in step S101 (e.g., step S302).

More specifically, for example, in the illustrative embodiment, as illustrated in FIG. 8A, the flash memory 84 stores a cause determination table. The cause determination table contains data including combinations each of a distribution pattern and a cause of an ejection failure regarding the nozzles 10 of the print head 4. In the cause determination table, the distribution pattern indicates locations of one or more failure nozzles each from which ink is not normally ejected. The flash memory 84 is an example of a storage. The data contained in the cause determination table is an example of first data. In a case where the cause determination table includes an applicable combination, the controller 80 determines that the cause of the currently-occurring ejection failure can be determined (e.g., YES in step S301). More specifically, the applicable combination includes a distribution pattern equivalent to the distribution pattern shown by the result of the ejection determination processing executed in step S101 and a cause of an ejection failure associated with the distribution pattern. In such a case, in step S302, the controller 80 determines the cause of the currently-occurring ejection failure based on the distribution pattern obtained from the result of the ejection determination processing executed in step S101 and the combination included in the cause determination table.

For example, as illustrated in FIG. 8A, the cause determination table includes various distribution patterns shown as, for example, "PATTERN 1", "PATTERN 2", and "PATTERN 3. The distribution pattern "PATTERN 1" indicates, for example, that failure nozzles are included in the endmost nozzles 10 in at least one of the nozzle rows 9 in the conveyance direction. The distribution pattern "PATTERN 2" indicates, for example, that one or more failure nozzles are included in the nozzles 10 constituting the endmost nozzle rows 9 in the scanning direction. The cause determination table further includes various causes shown as, for example, "CAUSE 1", "CAUSE 2", and "CAUSE 3". The cause "CAUSE 1" indicates, for example, that the cause of the ejection failure is high ink viscosity. The cause "CAUSE 2" indicates, for example, that the cause of the ejection failure is air intrusion in the nozzle 10.

The cause determination table of FIG. 8A includes, for example, a combination of the distribution pattern indicating that failure nozzles are included in the endmost nozzles 10 in at least one of the nozzle rows 9 in the conveyance direction (e.g., "PATTERN 1") and the cause of the ejection failure indicating high ink viscosity (e.g., "CAUSE 1"). The cause estimation table further includes a combination of the distribution pattern indicating that one or more failure nozzles are included in the nozzles 10 constituting the endmost nozzle rows 9 in the scanning direction (e.g., "PATTERN 2") and the cause of the ejection failure indicating air intrusion in the nozzle 10 (e.g., "CAUSE 2").

Subsequent to determining the cause of the currently-occurring ejection failure in step S302, the controller 80 determines whether a maintenance determination table contains data regarding the actual use period of the printer 1 (e.g., step S303). More specifically, for example, as illustrated in FIG. 8B, the flash memory 84 further stores the maintenance determination table. The maintenance determination table contains data including combinations of a cause of an ejection failure, a maintenance manner, and a use period regarding the printer 1. The data contained in the maintenance determination table is an example of second data.

The maintenance determination table includes a use period of the printer 1 shown as, for example, "PERIOD 1". The use period "PERIOD 1" indicates, for example, the season or the month or months. The maintenance determination table further includes various maintenance manners shown as, for example, "MANNER 1", "MANNER 2", and "MANNER 3". Each maintenance manner includes, for example, a suction purge, wiping, and flushing described above that are performed in this order. In the illustrative embodiment, the controller 80 causes the suction pump 62 to selectively perform a suction purge in one of various purge manners. In the different purge manners, the suction pump 62 is driven for respective different durations. An amount of ink to be discharged in a suction purge differs among the different maintenance manners included in the maintenance determination table of FIG. 8B. Thus, among the various maintenance manners, the longer driving duration of the suction pump 62 in the suction purge, the more amount of ink is discharged and the longer time is required for maintenance. A suction purge is an example of liquid discharging.

In step S303, the controller 80 determines whether the maintenance determination table includes the actual use period of the printer 1 (e.g., the date and time indicated by a signal output from the clock 71). If the controller 80 determines that the maintenance determination table does not include the actual use period of the printer 1 (e.g., NO in step S303), the controller 80 executes table update processing (e.g., step S304). Then, the routine proceeds to step S305. If the controller 80 determines that the maintenance determination table includes the actual use period of the printer 1 (e.g., YES in step S303), the routine proceeds to step S305.

Figure 7B:
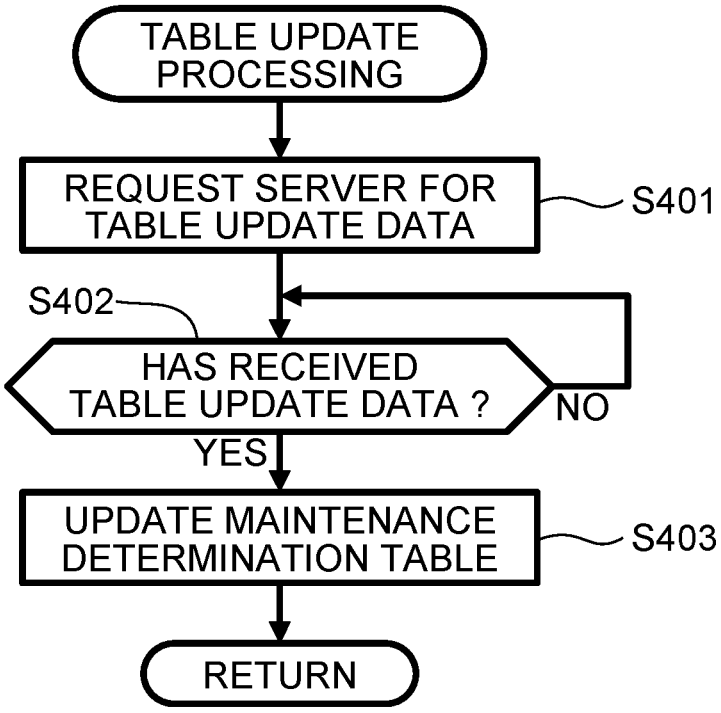
FIG. 7B is a flowchart of table update processing included in the flowchart of FIG. 7A according to one or more embodiments of the disclosure.

In the table update processing of step S304, as illustrated in FIG. 7B, the controller 80 requests the server 101 for table update data applicable to the actual use period of the printer 1 (e.g., the date and time indicated by the signal output from the clock 71) (e.g., step S401) and waits until the controller 80 has received the table update data (e.g., NO in step S402). If the controller 80 determines that the controller 80 has received the table update data (e.g., YES in step S402), the controller 80 updates the maintenance determination table based on the received table update data (e.g., step S403).

Figure 9A:
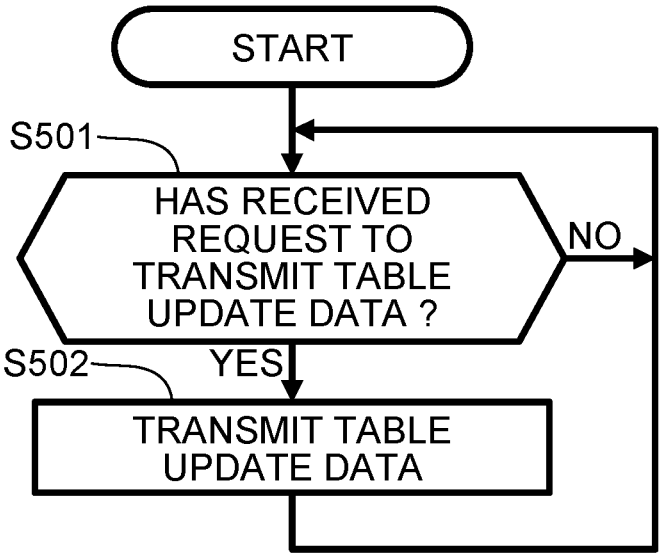
FIG. 9A is a flowchart of processing to be executed in a server in response to execution of the table update processing according to one or more embodiments of the disclosure.

In response to receiving the request from the printer 1, the server 101 executes processing of FIG. 9A. More specifically, for example, the server 101 waits until it has received, from the printer 1, a request to transmit table update data (e.g., NO in step S501). In response to receiving the request from the printer 1 (e.g., YES in step S501), the server 101 transmits table update data to the printer 1 (e.g., step S502). Then, the routine returns to step S501.

As illustrated in FIG. 10, the server 101 stores a table containing data including combinations each of a distribution pattern, a cause of an ejection failure, and a maintenance manner. Each combination is further associated with a corresponding use region and a corresponding use period. Each use region of the printer 1 (e.g., "REGION 1" or "REGION 2" in FIG. 10) indicates, for example, a country or region in which the printer 1 is used.

The table update data may be combination data including one or more combinations each of a cause of an ejection failure and a maintenance manner further associated with a use region and a use period appropriate for the printer 1 that has sent the request to the server 101, among the combinations included in the table of FIG. 10. Thus, updating the maintenance determination table based on the received table update data in the printer 1 in step S403 may enable the maintenance determination table to include the one or more combinations each of a cause of an ejection failure and a maintenance manner appropriate for the actual use period of the printer 1.

Returning to FIG. 7A, in step S305, the controller 80 determines a maintenance manner to be adopted based on the cause of the currently-occurring ejection failure determined in step S302 and the maintenance determination table of FIG. 8B. Subsequent to step S305 in which the controller 80 determines the maintenance manner to be adopted, the routine proceeds to step S105.

If the controller 80 determines that the cause of the currently-occurring ejection failure cannot be determined, that is, the ejection failure has occurred due to an unknown cause (e.g., NO in step S301), the controller 80 transmits, to the server 101, the distribution pattern shown by the result of the ejection determination executed in step S101 to make a query whether the table of FIG. 10 includes an applicable combination (e.g., step S306).

Figure 9B:
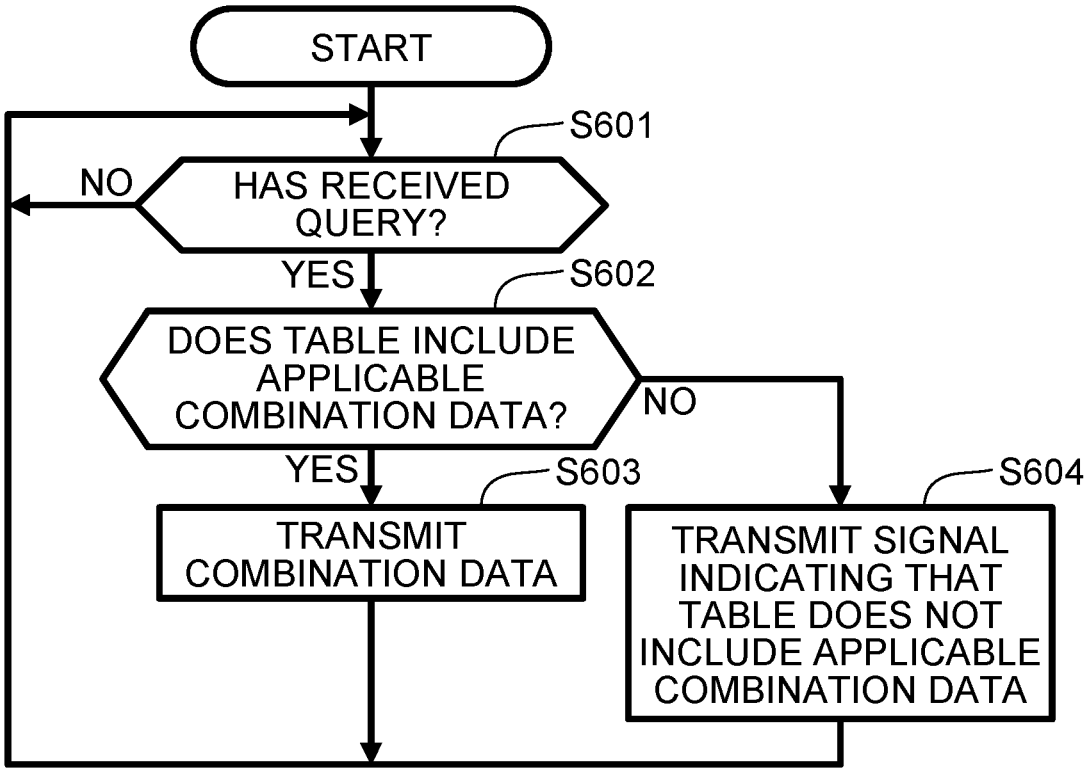
FIG. 9B is a flowchart of processing to be executed in the server in response to a query received from one of the printers according to one or more embodiments of the disclosure.

In response to receiving the query from the printer 1, the server 101 executes processing of FIG. 9B. More specifically, for example, the server 101 waits until it has received a query from the printer 1 (e.g., NO in step S601). In response to receiving the query from the printer 1 (e.g., YES in step S601), the server 101 determines, based on the distribution pattern received from the printer 1, whether the table of FIG. 10 includes an applicable combination of a use region equivalent to the use region of the printer 1, a use period equivalent to the use period of the printer 1, a cause of an ejection failure, a maintenance manner, and a distribution pattern equivalent to the distribution pattern received from the printer 1 (e.g., step S602).

If the server 101 determines that the table of FIG. 10 includes the applicable combination (e.g., YES in step S602), the server 101 transmits combination data including the applicable combination to the printer 1 (e.g., step S603). Then, the routine returns to step S601. If the server 101 determines that the table of FIG. 10 stored in the server 101 does not include the applicable combination data (e.g., NO in step S602), the server 101 transmits, to the printer 1, a signal indicating that the table stored in the server 101 does not include the applicable combination data (e.g., step S604). Then, the routine returns to step S601.

Referring back to FIG. 7A, subsequent to step S306, the controller 80 of the printer 1 waits until it has received, from the server 101, a response to the query transmitted to the server 101 in step S306 (e.g., NO in step S307). The response received from the server 101 may include the applicable combination data or the signal indicating that the table does not include the applicable combination data.

If the controller 80 determines that the controller 80 has received a response to the query from the server 101 (e.g., YES in step S307), the controller 80 determines whether the response includes combination data (e.g., step S308). If the controller 80 determines that the response includes combination data (e.g., YES in step S308), the controller 80 determines, based on the received combination data, a maintenance manner to be adopted (e.g., step S309). Subsequent to step S309, based on the received combination data, the controller 80 adds one or more new combinations each of a distribution pattern and a cause of an ejection failure to the cause determination table of FIG. 8A and adds one or more new combinations of a cause of an ejection failure and a maintenance manner to the maintenance determination table of FIG. 8B (e.g., step S310). Then, the routine proceeds to step S104 of FIG. 5.

As illustrated in FIG. 7, if the controller 80 determines that the response does not include combination data, that is, the response includes a signal indicating that the table stored in the server 101 does not include the applicable combination data (e.g., NO in step S308), the controller 80 determines to adopt the maintenance manner in which the suction pump 62 is driven for the longest duration in a suction purge among the various maintenance manners (e.g., step S311). Then, the routine proceeds to step S104 of FIG. 5.

As illustrated in FIG. 5, subsequent to the maintenance determination processing executed in step S103, the controller 80 executes maintenance processing (e.g., step S104). Subsequent to step S104, the controller 80 executes the ejection determination processing again (e.g., step S105). Subsequent to step S105, the controller 80 determines, based on the result of the ejection determination in step S105, whether the nozzles 10 of the inkjet head 4 include a failure nozzle (e.g., step S106). That is, in step S106, the controller 80 determines whether the ejection failure has been recovered by execution of the maintenance processing in step S104.

If the controller 80 determines that the nozzles 10 of the inkjet head 4 do not include a failure nozzle (i.e., the ejection failure has been recovered) (e.g., NO in step S106), the controller 80 determines whether the currently-specified maintenance manner is executed in step S104 for the first time (hereinafter, such a maintenance manner is referred to as a first-time executed maintenance manner) (e.g., step S107). In a case where, in step S702, the maintenance manner adopted in step S104 has been changed to another maintenance manner different from the maintenance manner previously adopted in step S104 and maintenance has been performed in the newly-specified or post-change maintenance manner for the first time, the controller 80 determines that the currently-specified maintenance manner is executed in step S104 for the first time (e.g., YES in step S107). In such a case, the controller 80 transmits information to the server 101 (e.g., step S108). The information includes the cause of the currently-occurring ejection failure determined in step S302, the currently-specified maintenance manner adopted in step S104, and information indicating that the ejection failure due to the determined cause has been recovered by the currently-specified maintenance manner adopted in step S104. Then, the routine proceeds to step S109.

In a case where the controller 80 determines that the nozzles 10 of the inkjet head 4 do not include a failure nozzle (e.g., NO in step S106) and that the currently-specified maintenance manner is not the first-time executed maintenance manner (e.g., NO in step S107), the routine proceeds to step S109. In step S109, the controller 80 increments a value of a variable "Kmn" by one. The variable Kmn is specified for each combination of a variable "m" and a variable "n". The variable m is assigned a value indicating one of the causes of the ejection failure. Different values are assigned to the respective different causes of the ejection failure. The variable n is assigned a value indicating one of the maintenance manners. Different values are assigned to the respective different maintenance manners. The value of the variable Kmn corresponds to the number of times the ejection failure occurring due to the cause indicated by the value of the variable m has been recovered using the maintenance manner indicated by the variable n.

If the controller 80 determines that the value of the variable Kmn that has been incremented in step S109 is equal to a certain value Kt (e.g., YES in step S110), that is, in a case where the ejection failure occurring due to the cause indicated by the value of the variable m has been recovered Kt times using the maintenance manner indicated by the variable n, the controller 80 executes association change processing (e.g., step S111). Then, the processing of FIG. 5 ends. The Kt times is an example of a predetermined number of times. If the controller 80 determines that the value of the variable Kmn that has been incremented in step S109 is not equal to the certain value Kt (e.g., NO in step S110), that is, in a case where the value of the variable Kmn is smaller than the certain value Kt (e.g., NO in step S110), the processing of FIG. 5 ends.

Association Change Processing

Figure 11:
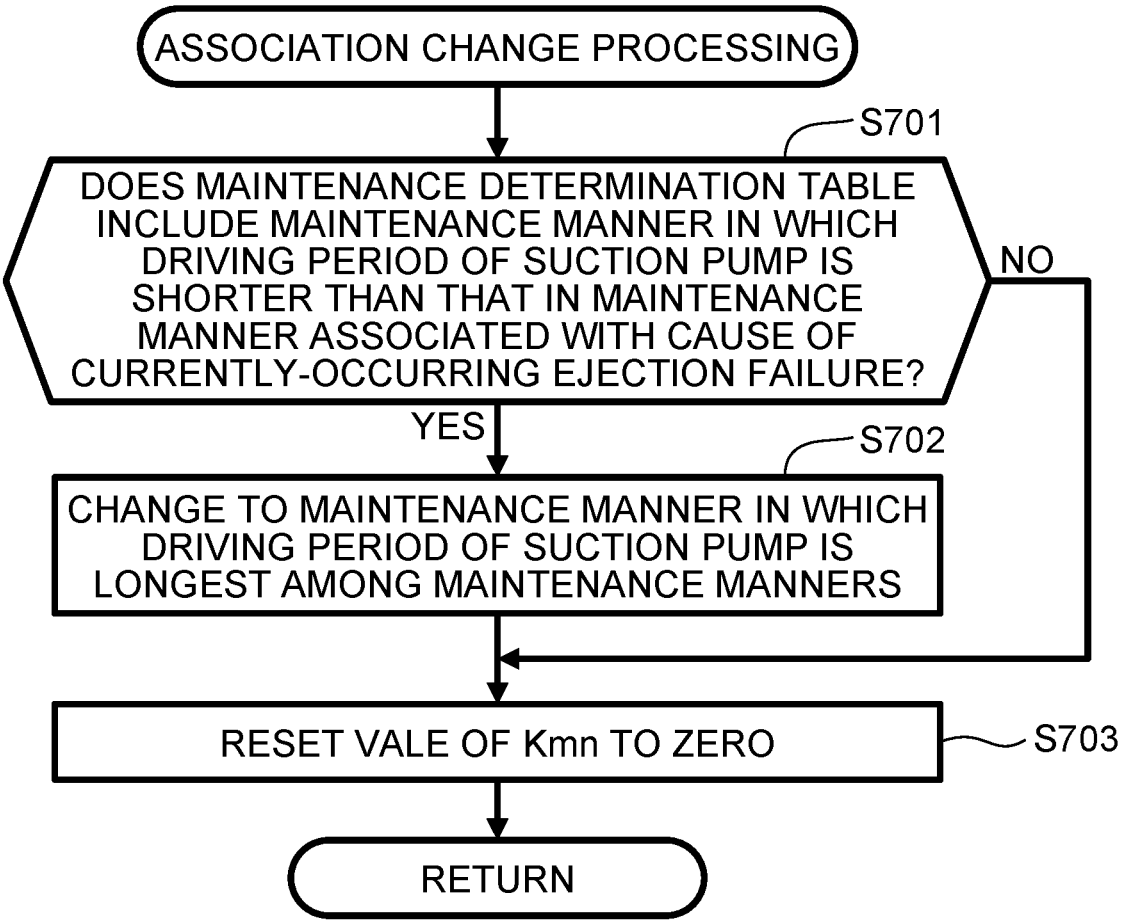
FIG. 11 is a flowchart of association change processing included in the flowchart of FIG. 5 according to one or more embodiments of the disclosure.

In the association change processing of step S111, as illustrated in FIG. 11, the controller 80 determines whether the maintenance determination table of FIG. 8B includes a maintenance manner in which the driving period of the suction pump 62 in a suction purge is shorter than that in the maintenance manner associated with the cause of the currently-occurring ejection failure determined in step S302 among the various maintenance manners (e.g., step S701). In a case where the maintenance determination table does not include such a maintenance manner (e.g., NO in step S701), the controller 80 resets the value of the variable Kmn to zero (e.g., step S703). Then, the routine returns to the processing of FIG. 5 and the processing of FIG. 5 ends.

In a case where the maintenance table includes one or more such maintenance manners (e.g., YES in step S701), the controller 80 changes, in the maintenance determination table, the maintenance manner associated with the cause of the currently-occurring ejection failure determined in step S302 to a maintenance manner in which the driving period of the suction pump 62 in a suction purge is the longest among the one or more maintenance manners (e.g., step S702). More specifically, for example, it is assumed that the period in which the suction pump 62 is driven in a suction purge in the maintenance manner determined in step S302 is 20 seconds and the maintenance table includes other maintenance manners in which the driving periods are different from each other. In a case where the maintenance table includes one or more maintenance manners in each of which the driving period of the suction pump 62 in a suction purge is shorter than 20 seconds, for example, 15 seconds, 10 seconds, or 5 seconds (e.g., YES in step S701), the controller 80 changes the maintenance manner associated with the cause of the currently-occurring ejection failure determined in step S302 to the maintenance manner in which the driving period of the suction pump 62 in a suction purge is 15 seconds that is the longest among the driving periods shorter than 20 seconds (e.g., step S702). That is, in step S702, the controller 80 changes the maintenance manner associated with the certain cause to the maintenance manner in which the driving period of the suction pump 62 in a suction purge is shorter than the current driving period. Subsequent to step S702, the controller 80 resets the value of the variable Kmn to zero (e.g., step S703). Then, the routine returns to the processing of FIG. 5 and the processing of FIG. 5 ends.

Returning to FIG. 5, in a case where the controller 80 determines that the nozzles 10 of the inkjet head 4 include a failure nozzle (i.e., the ejection failure has not been recovered) (e.g., YES in step S106) and the maintenance manner adopted in step S104 is not the first-time executed maintenance manner (e.g., NO in step S112), the controller 80 changes the maintenance manner associated with the cause of the currently-occurring ejection failure determined in step S302 to a maintenance manner in which the driving period of the suction pump 62 in suction purge is longer than the current driving period (e.g., step S113) and the routine returns to step S104.

In a case where the controller 80 determines that the nozzles 10 of the inkjet head 4 include a failure nozzle (e.g., YES in step S106) and the maintenance manner adopted in step S104 is the first-time executed maintenance manner (e.g., YES in step S112), the controller 80 transmits, to the server 101, information that the cause of the currently-occurring ejection failure has been determined in step S302, the currently-specified maintenance manner has been adopted in step S104, and the ejection failure due to the determined cause has not been recovered using the currently-specified maintenance manner adopted in step S104 (e.g., step S114). Subsequent to step S114, the controller 80 changes the maintenance manner associated with the cause of the currently-occurring ejection failure determined in step S302 to the previous maintenance manner before changed in step S702 (i.e., the pre-change maintenance manner) in the maintenance determination table of FIG. 8B (e.g., step S115). Then, the routine returns to step S103.

In the illustrative embodiment, in a case where the association of the maintenance manner with the certain cause is changed in step S702 of the association change processing of step S111, the pre-change maintenance manner corresponds to a first maintenance manner and the post-change maintenance manner corresponds to a second maintenance manner.

Combination Data Generation in Server Based on Information from Printers

In the illustrative embodiment, each printer 1 connected to the server 101 transmits information to the server 101 in step S108 or S114. In response to receiving such information from the printers 1, the server 101 executes processing of FIG. 12A.

More specifically, for example, the server 101 waits until information received from one or more of the printers 1 is sufficiently collected (e.g., NO in step S801). The sufficient amount of information refers to the amount of information collected enough to appropriately establish associations between causes of ejection failures and maintenance manners. If the controller 80 determines that the sufficient amount of information has been collected (e.g., YES in step S801), the server 101 establishes, based on the information received from the printers 1, associations between causes of ejection failures and maintenance manners for each use region and each use period (e.g., step S802). For example, the server 101 includes a learner that executes machine learning. In step S802, the server 101 establishes such associations by causing the learner to execute machine learning based on the information received from the printers 1.

Subsequent to step S802, the server 101 generates, based on the association result of step S802, combination data including one or more combinations each of a cause of an ejection failure and a maintenance manner for each use region and each use period (e.g., step S803). Subsequent to step S803, the server 101 transmits the generated combination data to one or more of the printers 1 applicable to the use region and the use period (e.g., step S804). Subsequent to step S804, the server 101 updates the table of FIG. 10 stored therein based on the combination data generated in step S803 (e.g., step S805). Then, the routine returns to step S801.

Figure 12A:
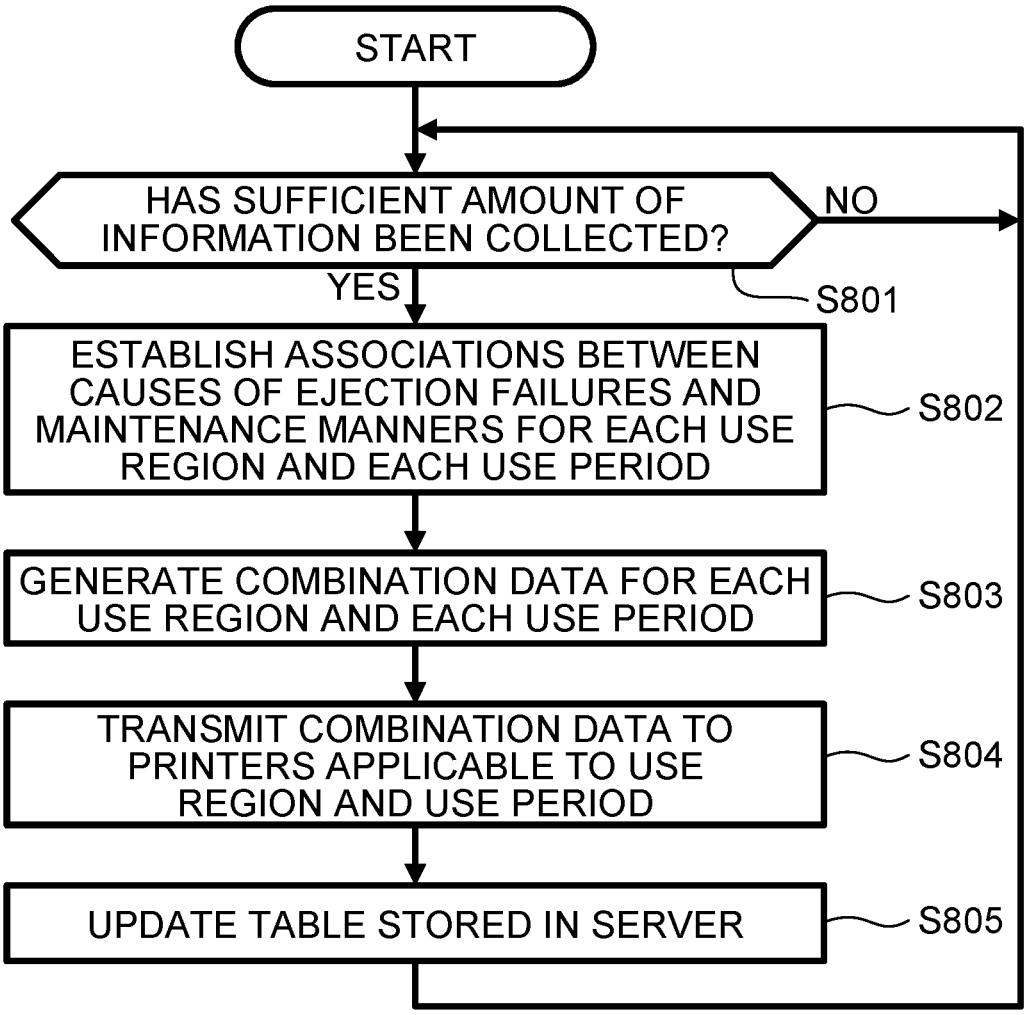
FIG. 12A is a flowchart of processing to be executed in the server according to one or more embodiments of the disclosure, wherein the processing includes generating combination data, based on data received from the printers, used for changing associations in the maintenance determination table and transmitting the generated combination data to one or more applicable printers among the printers.
Figure 12B:
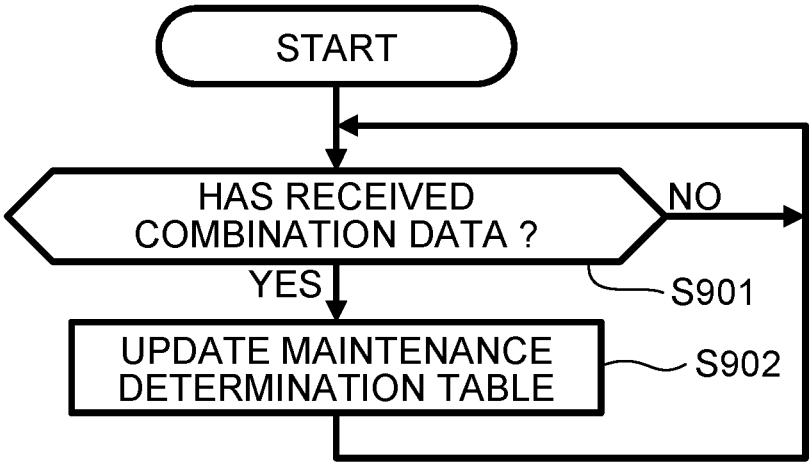
FIG. 12B is a flowchart of processing to be executed in each printer in response to execution of the processing of FIG. 12A according to one or more embodiments of the disclosure.

In response to the processing of FIG. 12A executed in the server 101, in the applicable printer 1, the controller 80 executes processing of FIG. 12B, while, for example, not recording on a recording sheet P. More specifically, for example, the controller 80 waits until it has received the combination data transmitted by the server 101 in step S804 (e.g., NO in step S901). In response to receiving the combination data from the server 101 (e.g., YES in step S901), the controller 80 updates the maintenance determination table of FIG. 8B based on the received combination data (e.g., step S902). Updating the maintenance determination table may increase in variety of combinations of a cause of an ejection failure and a maintenance manner. Subsequent to step S902, the routine returns to step S901.

Effects

In the illustrative embodiment, in a case where the maintenance determination table includes a combination of a certain cause and a certain maintenance manner (e.g., the first maintenance manner), in some cases, the controller 80 of the printer 1 determines that the certain cause is the cause of a currently-occurring ejection failure and the currently-occurring ejection failure can be recovered by maintenance in the certain maintenance manner. Nevertheless, even in such a case, the certain maintenance manner associated with the certain cause might not be suitable for the use environment of the printer 1. For example, adopting the certain maintenance manner may cause an excessive ink discharge in a suction purge.

In the illustrative embodiment, thus, in a case where the ejection failure occurring due to the certain cause has been recovered a certain number of times by maintenance in the same maintenance manner (e.g., the first maintenance manner) (e.g., YES in step S110), the association of the maintenance manner with the certain cause is changed to another maintenance manner (e.g., the second maintenance manner). In this case, in a case where, after the association of the maintenance manner with the certain cause is changed, the controller 80 determines that the certain cause is the cause of the currently-occurring ejection failure, the controller 80 executes the maintenance processing to perform maintenance in the post-change maintenance manner (e.g., the second maintenance manner). Thereafter, the controller 80 determines whether the currently-occurring ejection failure has been recovered by maintenance in the post-change maintenance manner. With this determination, the controller 80 determines whether the post-change maintenance manner is effective to recover the ejection failure occurring due to the certain cause. Using such a determination result may improve appropriateness of the associations between the causes of the ejection failure and the maintenance manners in the maintenance determination table.

In the illustrative embodiment, among the respective different maintenance manners, the ink discharge amount differs in a suction purge. Thus, even when an ejection failure occurs due to the same cause, the determination result of whether the maintenance manner is effective to recover the ejection failure may highly vary among the different maintenance manners. Thus, improving appropriateness of the associations between the causes of the ejection failure and the maintenance manners may have great significance.

In the illustrative embodiment, in a case where the ejection failure occurring due to the certain cause has been recovered the certain number of times by maintenance in the same maintenance manner, the association of the maintenance manner with the certain cause is changed to another maintenance manner in which the driving period of the suction pump 62 in a suction purge is shorter than that in the maintenance manner associated with the cause of the currently-occurring ejection failure determined in step S302 among the various maintenance manners. Thereafter, in a case where the controller 80 determines that the ejection failure occurring due to the certain cause has been recovered by maintenance in the post-change maintenance manner, the post-change maintenance manner is associated with the certain cause. Thus, in a case where an ejection failure occurs due to the certain cause in future, the ejection failure may be recovered by maintenance in the maintenance manner in which the ink discharge amount is less than before and the time required for the maintenance is shorter than before.

In the illustrative embodiment, in a state where the carriage 2 is located at the maintenance position, the inkjet head 4 is driven to discharge ink toward the detection electrode 66 in the cap 61 from a target nozzle 10 of the nozzles 10. In response to this, the determination circuit 68 outputs a determination signal. The controller 80 may thus execute the ejection determination to determine, based on the determination signal received from the determination circuit 68, whether the target nozzle 10 is a failure nozzle.

In the illustrative embodiment, after changing the association of the maintenance manner with the certain cause, in a case where the controller 80 determines that the certain cause is the cause of the currently-occurring ejection failure, the controller 80 executes the maintenance processing to perform maintenance in the post-change maintenance manner. Thereafter, the controller 80 executes the ejection determination processing to determine whether the nozzles 10 of the inkjet head 4 include a failure nozzle. That is, the controller 80 determines whether the ejection failure occurring due to the certain cause has been recovered by the maintenance in the post-change maintenance manner. Thus, the controller 80 may determine whether the post-change maintenance manner is associated with the certain cause without problems.

In the illustrative embodiment, in a case where the ejection failure occurring due to the certain cause has not been recovered by the maintenance in the post-change maintenance manner, the controller 80 changes the maintenance manner associated with the certain cause back to the pre-change maintenance manner. Thus, in a case where an ejection failure occurs due to the certain cause in future, the ejection failure may be recovered by maintenance in the pre-change maintenance manner.

In the illustrative embodiment, two or more printers 1 are connected to the server 101 via the network 99. The server 101 generates, based on the information received from each printer 1, suitable combination data including one or more combinations of a cause of an ejection failure and a maintenance manner, and transmits the generated combination data to one or more applicable printers 1 of the printers 1. Based on the received combination data, each printer 1 that has received the combination data updates its maintenance determination table of FIG. 8B. This may thus improve appropriateness of the associations between the causes of the ejection failure and the maintenance manners in the maintenance determination table in each printer 1.

In the illustrative embodiment, the server 101 establishes one or more combinations of a cause of an ejection failure and a maintenance manner for each use region and each use period. The server 101 then transmits combination data including the one or more combinations to one or more of the printers 1 applicable to the use region and use period. This may thus improve appropriateness of the associations between the causes of the ejection failure and the maintenance manners in the maintenance determination table in each printer 1 and the associations in the maintenance determination table may be further suitable for the use region and use period of the printer 1.

In the illustrative embodiment, the server 101 generates and stores combination data including one or more combinations of a cause of an ejection failure and a maintenance manner for each use period of the printer 1. In a case where the maintenance determination table stored in the flash memory 84 does not include the actual use period of the printer 1, the printer 1 obtains, from the server 101, combination data including one or more combinations of a cause of an ejection failure and a maintenance manner associated with a particular use period corresponding to the actual use period of the printer 1. Based on the received combination data, the printer 1 updates the maintenance determination table to associate the one or more combinations of a cause of an ejection failure and a maintenance manner with the particular use period corresponding to the actual use period of the printer 1. Temperature and humidity may vary depending on the use period of the printer 1. Thus, the same maintenance manner might not be always suitable to recover the ejection failure occurring due to the certain cause. According to the illustrative embodiment, updating the maintenance determination table may increase in variety of combinations of a cause of the ejection failure and a maintenance manner. Thus, the combinations in the maintenance determination table may be further suitable for the use period of the printer 1.

In a case where, in the printer 1, the currently-occurring ejection failure has occurred due to an unknown cause that cannot be determined based on the distribution pattern shown by the result of the ejection determination processing executed in step S101 and the cause determination table of FIG. 8A stored in the flash memory 84, the controller 80 of the printer 1 transmits, to the server 101, a query as to whether the server 101 stores an applicable combination including a cause of an ejection failure and a distribution pattern equivalent to a distribution pattern indicating the currently-occurring ejection failure due to the unknown cause, and a maintenance manner. In a case where the server 101 stores the applicable combination, the printer 1 obtains combination data including the applicable combination from the server 101 and performs maintenance in the maintenance manner based on the received combination data. This enables the printer 1 to perform maintenance in a suitable maintenance manner for an ejection failure due to an unknown cause.

In the illustrative embodiment, based on the received combination data, the controller 80 adds a new combination including a distribution pattern equivalent to the distribution pattern shown by the result of the ejection determination processing executed in step S101 and a cause of an ejection failure corresponding to the unknown cause to the cause determination table of FIG. 8A and adds a new combination including a cause of an ejection failure corresponding to the unknown cause and a maintenance manner to the maintenance determination table of FIG. 8B. Thus, in a case where an ejection failure occurs in future due to the same cause as the unknown cause, the printer 1 may perform maintenance in a suitable maintenance manner based on the cause determination table and the maintenance determination table to be updated in the flash memory 84.

Modifications

While the disclosure has been described in detail with reference to the specific embodiment thereof, this is merely an example, and various changes, arrangements and modifications may be applied therein without departing from the spirit and scope of the disclosure.

In the illustrative embodiment, in a case where the ejection failure has occurred due to an unknown cause that cannot be determined based on the distribution pattern shown by the result of the ejection determination processing executed in step S101 and the cause determination table (e.g., NO in step S301), the controller 80 makes a query by transmitting, to the server 101, the distribution pattern shown by the result of the ejection determination processing executed in step S101 (e.g., step S306). In response receiving, from the server 101, combination data as a response to the query (e.g., YES in step S308), the controller 80 determines, based on the received combination data, the maintenance manner to be adopted (e.g., step S309), and adds one or more combinations included in the combination data to the cause determination table and the maintenance determination table (e.g., step S310).

Nevertheless, in other embodiments, for example, in a case where the combination data received from the server 101 includes a rare cause of the ejection failure or in a case where the flash memory 84 does not have much capacity, the controller 80 might not necessarily add one or more combinations included in the received combination data to the cause determination table and the maintenance determination table.

In other embodiments, for example, in a case where the ejection failure has occurred due to an unknown cause that cannot be determined based on the distribution pattern shown by the result of the ejection determination processing executed in step S101 and the cause determination table (e.g., NO in step S301), the controller 80 may execute the maintenance processing to perform maintenance in a particular maintenance manner among the various maintenance manners without transmitting a query to the server 101. The particular maintenance manner may be, for example, the maintenance manner in which the driving period of the suction pump 62 in a suction purge is the longest (i.e., the largest amount of ink is discharged) among the one or more maintenance manners stored in the flash memory 84.

In the illustrative embodiment, in the maintenance determination table of FIG. 8B, the combinations of a cause of an ejection failure and a maintenance manner are further associated with the use period of the printer 1. In a case where the maintenance determination table does not include the actual use period of the printer 1, the printer 1 obtains, from the server 101, combination data including one or more combinations of a cause of an ejection failure and a maintenance manner applicable to the actual use period of the printer 1. Based on the obtained combination data, the controller 80 updates the maintenance determination table.

Nevertheless, in other embodiments, for example, in the maintenance determination table of FIG. 8B, the combinations of a cause of an ejection failure and a maintenance manner might not necessarily be associated with the use period of the printer 1. In such a case, the controller 80 might not necessarily update the maintenance determination table.

In the illustrative embodiment, as illustrated in FIG. 10, the server 101 stores the table including the combinations of a distribution pattern, a cause of an ejection failure, and a maintenance manner. In the table, each combination is further associated with a corresponding use region and a corresponding use period of the printer 1. Nevertheless, in other embodiments, for example, the server 101 may store a table including combinations of a distribution pattern, a cause of an ejection failure, and a maintenance manner, each combination further associated with a corresponding use environment of the printer 1 such as temperature and humidity. In such a case, the server 101 may transmit combination data including one or more combinations of a distribution pattern, a cause of an ejection failure, and a maintenance manner to one or more of the printers 1 applicable to the use environment.

In other embodiments, for example, the server 101 may establish one or more combinations of a cause of an ejection failure and a maintenance manner for common use in all the printers 1 connected to the server 101 via the network 99. In such a case, each combination might not be associated with a use environment. The server 101 may transmit combination data including the one or more combinations to all the printers 1.

In the illustrative embodiment, two or more printers 1 are connected to the server 101 via the network 99. The server 101 generates, based on the information received from each printer 1, combination data including one or more combinations of a cause of an ejection failure and a maintenance manner, and transmits the generated combination data to one or more applicable printers 1 of the printers 1. Based on the combination data received from the server 101, each printer 1 that has received the combination data updates its maintenance determination table of FIG. 8B.

Nevertheless, in other embodiments, for example, the printers 1 might not necessarily be connected to the server 101. In such a case, the server 101 might not necessarily generate combination data including one or more combinations of a cause of an ejection failure and a maintenance manner. Each printer 1 might not necessarily update its maintenance determination table.

In a case where the nozzles 10 of the inkjet head 4 include a failure nozzle (e.g., YES in step S106) and the maintenance manner adopted in step S104 is the first-time executed maintenance manner (e.g., YES in step S112), the controller 80 changes the maintenance manner associated with the certain cause back to the pre-change maintenance manner (e.g., step S115).

Nevertheless, in other embodiments, for example, in a case where an ejection failure due to the certain cause has not been recovered by maintenance in the post-change maintenance manner, the controller 80 may change, in the maintenance determination table, the association of the maintenance manner with the certain cause to another maintenance manner other than the pre-change maintenance manner and the post-change maintenance manner.

In the illustrative embodiment, in a case where the controller 80 changes the maintenance manner associated with the certain cause to another maintenance manner, in response to determining, for the next time, that the ejection failure has occurred due to the certain cause, the controller 80 executes the maintenance processing to perform maintenance in the post-change maintenance manner. Thereafter, the controller 80 executes the ejection determination processing to determine whether the ejection failure occurring due to the certain cause has been recovered by maintenance in the post-change maintenance manner. Nevertheless, in other embodiments, for example, the controller 80 might not necessarily determine whether the ejection failure occurring due to the certain cause has been recovered by maintenance in the post-change maintenance manner.

In the illustrative embodiment, among the different maintenance manners, the driving period of the suction pump 62 differs in a suction purge. In a case where an ejection failure occurring due to the certain cause has been recovered the certain number of times by maintenance in the same maintenance manner (i.e., Kmn=Kt), the association of the maintenance manner with the certain cause is changed to another maintenance manner in which the driving period of the suction pump 62 in a suction purge is shorter than that in the pre-change maintenance. Thus, the association of the maintenance manner with the certain cause is changed to the maintenance manner in which the amount of ink to be discharged is less than that in the pre-change maintenance manner and the time required for maintenance is shorter than that in the pre-change maintenance manner.

Nevertheless, in other embodiments, for example, the controller 80 may cause the suction pump 62 to selectively perform a suction purge in one of various purge manners. In such a case, the suction pump 62 may be driven at different rotation speeds among the different purge manners, and driven for the same driving period. In addition, among the different maintenance manners, a suction purge may be performed in respective different manners. In a case where an ejection failure occurring due to the certain cause has been recovered the certain number of times by maintenance in the same maintenance manner (i.e., Kmn=Kt), the association of the maintenance manner with the certain cause may be changed to another maintenance manner in which the rotation speed of the suction pump 62 in a suction purge is slower than that in the pre-change maintenance. With this change, while the amount of ink to be discharged decreases in the post-change maintenance manner associated with the certain cause, the time required for maintenance in the post-change maintenance manner might not be changed.

Alternatively, in a case where an ejection failure occurring due to the certain cause has been recovered the certain number of times by maintenance in the same maintenance manner (i.e., Kmn=Kt), the association of the maintenance manner with the certain cause may be changed to another maintenance manner (or a post-change maintenance manner) in which the amount of ink to be discharged is greater than that in the pre-change maintenance manner. In this case, the amount of ink to be discharged may increase to some extent. However, in a case where the time that elapses until an ejection failure due to the certain cause occurs next time is sufficiently longer in the post-change maintenance manner than in the pre-change maintenance manner, the post-change maintenance manner may be suitable to be associated with the certain cause.

Alternatively, both of the driving period and the rotation speed of the suction pump 62 may differ among the different maintenance manners. In a case where an ejection failure occurring due to the certain cause has been recovered the certain number of times by maintenance in the same maintenance manner (i.e., Kmn=Kt), the association of the maintenance manner with the certain cause may be changed to another maintenance manner in which the driving period of the suction pump 62 in a suction purge is shorter than that in the pre-change maintenance. Such a change may thus shorten the time required for maintenance in the post-change maintenance manner associated with the certain cause as compared with the time required for maintenance in the pre-change maintenance manner.

Alternatively, in a case where an ejection failure occurring due to the certain cause has been recovered the certain number of times by maintenance in the same maintenance manner (i.e., Kmn=Kt), the association of the maintenance manner with the certain cause may be changed to another maintenance manner in which the time required for maintenance is longer than that in the pre-change maintenance manner. In this case, the time required for maintenance in the post-change maintenance manner may increase to some extent. However, in a case where time that elapses until an ejection failure due to the certain cause occurs next time is sufficiently longer in the post-change maintenance manner than in the pre-change maintenance manner, the post-change maintenance manner may be suitable to be associated with the certain cause.

In the illustrative embodiment, the ink discharge amount in a suction purge differs among the different purge manners. Thus, the ink discharge amount differs among the respective different maintenance manners. Nevertheless, in other embodiments, for example, the ink discharge amount in flushing may differ among different flushing manners. Thus, the ink discharge amount may differ among the respective different maintenance manners. In still other embodiments, for example, the ink discharge amount in a suction purge may differ among different purge manners and the ink discharge amount in flushing may also differ among different flushing manners. Thus, the ink discharge amount may differ among the respective different maintenance manners.

In the illustrative embodiment, all the maintenance manners include a suction purge, wiping, and flushing that are performed in this order. Nevertheless, in other embodiments, for example, at least one of the maintenance manners may include a suction purge, wiping, and flushing that may be performed in another order.

In other embodiments, for example, at least one of the maintenance manners may include one or more of a suction purge, wiping, and flushing. In such a case, an operation for recovering an ejection failure performed in maintenance in the at least one of the maintenance manners might not necessarily include an ink discharge operation such as a suction purge and flushing.

The operation for recovering an ejection failure performed in maintenance may include another operation other than a suction purge, wiping, and flushing.

In these cases, also, in a case where an ejection failure occurring due to the certain cause has been recovered the certain number of times by maintenance in the same maintenance manner (i.e., Kmn=Kt), the association of the maintenance manner with the certain cause may be changed to another maintenance manner (or a post-change maintenance manner). Then, in response to an ejection failure occurring due to the certain cause, the controller 80 executes the maintenance processing to perform maintenance in the post-change maintenance manner. Thereafter, the controller 80 determines whether the currently-occurring ejection failure has been recovered by maintenance in the post-change maintenance manner. With this determination, the controller 80 may determine whether adopting the post-change maintenance manner is effective to recover the ejection failure occurring due to the certain cause. Using such a determination result may improve appropriateness of the associations between the causes of the ejection failure and the maintenance manners.

In the illustrative embodiment, in the ejection determination, the controller 80 determines whether, with respect to each of the nozzles 10 of the inkjet head 4, the nozzle 10 is a failure nozzle. Based on the determination result, the controller 80 determines the cause of the currently-occurring ejection failure. Nevertheless, in other embodiments, for example, in the ejection determination, the controller 80 may determine whether, with respect to each of a predetermined number of selected nozzles 10 among the nozzles 10 of the inkjet head 4, a selected nozzle 10 is a failure nozzle. Based on such a determination result, the controller 80 may determine the cause of the currently-occurring ejection failure.

In the illustrative embodiment, in response to the inkjet head 4 being driven for ejecting ink toward the detection electrode 66 from a target nozzle 10, the determination circuit 68 outputs a determination signal responsive to changes in voltage at the detection electrode 66.

Nevertheless, in other embodiments, for example, a pair of detection electrodes may be disposed so as to extend in the up-down direction. The detection electrodes may be spaced from and face each other such that ink is ejected between the detection electrodes. In response to the inkjet head 4 being driven for ejecting ink from a target nozzle 10, a determination circuit may output a determination signal responsive to changes in voltage at the detection electrodes. Alternatively, the printer 1 may include an optical sensor that may detect ink ejected from a target nozzle 10 and output a determination signal. The optical sensor is another example of the signal output unit.

Alternatively, a known technique for outputting a determination signal may be adopted. For example, a printer may include a voltage detection circuit connected to a nozzle plate of an inkjet head. In response to the inkjet head being driven for ejecting ink from a target nozzle, the voltage detection circuit may detect changes in voltage at the voltage detection circuit and output a determination signal to a controller. The voltage detection circuit is another example of the signal output unit.

Alternatively, another known technique for outputting a determination signal may be adopted. For example, a substrate of an inkjet head may include a temperature detection element. The temperature detection element is another example of the signal output unit. In such a case, a first voltage may be applied to a heater to allow the inkjet head to eject ink from a target nozzle. Then, a second voltage may be applied to the heater not to allow the inkjet head to eject ink from the target nozzle. The temperature detection element may output a determination signal based on changes in temperature detected by the temperature detection element in a certain time period since the application of the second voltage.

Alternatively, the printer 1 may record a certain test pattern for identifying one or more failure nozzles. In such a case, the user may operate an operation interface of the printer 1 to input information indicating, with respect to each nozzle 10, whether the nozzle 10 is a failure nozzle, based on the result of the test pattern recorded. Such information is another example of the distribution pattern. Alternatively, the printer 1 may be a multifunction peripheral including a scanner. In such a case, the recorded test pattern may be read by the scanner to input, to the controller 80, information (e.g., the distribution pattern) indicating, with respect to each nozzle 10, whether the nozzle 10 is a failure nozzle.

In the examples described above, the controller 80 determines whether, with respect to each nozzle 10, ink has been ejected therefrom, and determines, as a failure nozzle, the nozzle 10 from which ink has not been normally ejected. Nevertheless, in other embodiments, for example, the printer 1 may include a configuration for detecting an ejection speed or direction of ink ejected from each nozzle 10. Based on the detection result, the controller 80 may determine, as a failure nozzle, the nozzle 10 that cannot achieve an intended ink ejection speed or direction.

The disclosure has been applied to a printer including a serial head that moves in the scanning direction together with a carriage. Nevertheless, for example, the disclosure may be applied to a printer including a line head extending over the entire length of a recording sheet P in the scanning direction.

The disclosure has been applied to a printer that ejects ink from nozzles to record an image on a recording sheet P. Nevertheless, the disclosure may also be applied to another printer that may record an image on a recording medium other than a recording sheet. Examples of the recording media include a T-shirt, a sheet for outdoor advertisement, a casing of a mobile terminal such as a smartphone, a cardboard, and a resin member. Further, the disclosure may also be applied to a liquid ejection apparatus that may eject liquid other than ink such as liquid resin or liquid metal.

What is claimed is:

1. A liquid ejection apparatus comprising:

a liquid ejection head having an array of nozzles each configured to eject liquid;

a storage storing:

as first data, combinations each including one of distribution patterns and one of causes of an ejection failure, each distribution pattern indicating locations of one or more failure nozzles each from which liquid is not normally ejected; and as second data, combinations each including one of causes of an ejection failure and one of maintenance manners, the maintenance manners including a first maintenance manner and a second maintenance manner different from the first maintenance manner; and a controller configured to:

execute ejection determination to determine whether, with respect to each nozzle a nozzle normally has ejected liquid;

determine, based on a result of the ejection determination, whether the nozzles include a failure nozzle;

in a case where the controller determines that the nozzles include a failure nozzle, determine, based on the first data stored in the storage and a distribution pattern obtained from a result of the ejection determination, a cause of a currently-occurring ejection failure;

in a case where the controller determines that the cause of the currently-occurring ejection failure is a certain cause corresponding to a cause of an ejection failure included in the second data, execute maintenance processing to perform maintenance in the first maintenance manner associated with the certain cause;

subsequent to the execution of the maintenance in the first maintenance manner, execute again the ejection determination and determine, based on a result of the ejection determination, whether the currently-occurring ejection failure due to the certain cause has been recovered by the maintenance in the first maintenance manner; and in a case where the currently-occurring ejection failure due to the certain cause has been recovered a predetermined number of times by the maintenance in the first maintenance manner, change the first maintenance manner associated with the certain cause to the second maintenance manner in the second data.

2. The liquid ejection apparatus according to claim 1,
wherein the first maintenance manner and the second maintenance manner each include liquid discharging for causing the liquid ejection head to discharge liquid from the nozzles, and
wherein a liquid discharge amount in the first maintenance manner is different from a liquid discharge amount in the second maintenance manner.

3. The liquid ejection apparatus according to claim 2,
wherein the liquid discharge amount in the second maintenance manner is less than the liquid discharge amount in the first maintenance manner.

4. The liquid ejection apparatus according to claim 1,
wherein an operation time for the maintenance in the second maintenance manner is shorter than an operation time for the maintenance in the first maintenance manner.

5. The liquid ejection apparatus according to claim 1, further comprising a signal output unit configured to output, to the controller, a signal responsive to whether a nozzle of the nozzles has normally ejected liquid,
wherein the controller is further configured to:
drive the liquid ejection head to eject liquid from each of a predetermined number of selected nozzles among the nozzles;
execute the ejection determination with respect to each of the predetermined number of selected nozzles based on the signal received from the signal output unit; and
determine, based on a result of the ejection determination, the cause of the currently-occurring ejection failure.

6. The liquid ejection apparatus according to claim 1,
wherein, in a case where, subsequent to changing the first maintenance manner associated with the certain cause to the second maintenance manner in the second data, the controller determines that the cause of the currently-occurring ejection failure is the certain cause, the controller is configured to execute the maintenance processing to perform maintenance in the second maintenance manner, and
wherein, subsequent to the execution of the maintenance in the second maintenance manner, the controller is configured to execute again the ejection determination and determine, based on a result of the ejection determination, whether the currently-occurring ejection failure due to the certain cause has been recovered by the maintenance in the second maintenance manner.

7. The liquid ejection apparatus according to claim 6,
wherein, in a case where the controller determines that the currently-occurring ejection failure due to the certain cause has not been recovered by the execution of the maintenance in the second maintenance manner, the controller is configured to change the second maintenance manner associated with the certain cause back to the first maintenance manner.

8. A system comprising:
a plurality of liquid ejection apparatuses according to the liquid ejection apparatus of claim 6; and
a server connected to the plurality of liquid ejection apparatuses,
wherein, in at least one liquid ejection apparatus of the plurality of liquid ejection apparatuses, subsequent to determining whether the currently-occurring ejection failure due to the certain cause has been recovered by the maintenance in the second maintenance manner, the controller is configured to transmit, to the server, information indicating that the second maintenance manner has been associated with the certain cause and whether the currently-occurring ejection failure due to the certain cause has been recovered by the maintenance in the second maintenance manner,
wherein the server is configured to:
based on the information received from the controller, establish one or more associations between a cause of the ejection failure and a maintenance manner;
generate combination data including one or more combinations corresponding to the one or more associations, the one or more combinations each including a cause of the ejection failure and a maintenance manner; and
transmit the generated combination data to at least another one liquid ejection apparatus of the plurality of liquid ejection apparatuses, and
wherein, in the at least another one liquid ejection apparatus having received the combination data from the server, the controller is configured to update the second data based on the received combination data.

9. The system according to claim 8,
wherein, in the at least one liquid ejection apparatus, the controller is further configured to transmit, to the server, information on use environment of the at least one liquid ejection apparatus, and
wherein the server is further configured to:
establish, on a use environment basis, the one or more associations between the cause of the ejection failure and the maintenance manner;
generate the combination data on the use environment basis; and
transmit the generated combination data to the at least another one liquid ejection apparatus in a case where the at least another one liquid ejection apparatus is applicable to the use environment of the at least one liquid ejection apparatus.

10. The system according to claim 9,
wherein, in the at least one liquid ejection apparatus, the storage stores the second data including the combinations in association with the information on use environment,
wherein the information on use environment includes a use period of the at least one liquid ejection apparatus,
wherein the server is further configured to:
establish, on a use period basis, the one or more associations between the cause of the ejection failure and the maintenance manner; and
generate the combination data on the use period basis, and
wherein, in the at least one liquid ejection apparatus, the controller is further configured to:
in a case where the second data stored in the storage of the at least one liquid ejection apparatus does not include an actual use period thereof, obtain, from the server, combination data including a use period corresponding to the actual use period of the at least one liquid ejection apparatus; and
based on the obtained combination data, update the second data.

11. The system according to claim 8,
wherein the server stores, as combination data, combinations each including a distribution pattern, a cause of an ejection failure, and a maintenance manner,
wherein, in the at least one liquid ejection apparatus, in a case where the currently-occurring ejection failure has occurred due to an unknown cause that cannot be determined based on the first data and a distribution pattern obtained from a result of the ejection determination, the controller is further configured to transmit, to the server, the obtained distribution pattern that indicates the currently-occurring ejection failure due to the unknown cause to make a query as to whether the server stores an applicable combination including a cause of an ejection failure, a distribution pattern equivalent to the obtained distribution pattern, and a maintenance manner, wherein the server is further configured to, in a case where the server stores the applicable combination, transmit the combination data including the applicable combination to the at least one liquid ejection apparatus having transmitted the query to the server, and wherein, in the at least one liquid ejection apparatus having received the combination data from the server, the controller is further configured to perform maintenance in the maintenance manner included in the applicable combination based on the received combination data.

12. The system according to claim 11, wherein, in the at least one liquid ejection apparatus having received the combination data from the server, the controller is further configured to:

based on the received combination data, add, to the first data stored in the storage, a combination including a distribution pattern equivalent to the distribution pattern that indicates the currently-occurring ejection failure due to the unknown cause and a cause of an ejection failure corresponding to the unknown cause; and add, to the second data stored in the storage, a combination including a cause of an ejection failure corresponding to the unknown cause and a maintenance manner.

* * * * *